US006800799B2

(12) United States Patent
Fujiwara et al.

(10) Patent No.: US 6,800,799 B2
(45) Date of Patent: Oct. 5, 2004

(54) RECORDER, METHOD FOR RECORDING MUSIC, PLAYER, METHOD FOR REPRODUCING THE MUSIC AND SYSTEM FOR ENSEMBLE ON THE BASIS OF MUSIC DATA CODES DIFFERENTLY FORMATTED

(75) Inventors: Yuji Fujiwara, Hamamatsu (JP); Rei Furukawa, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/383,810

(22) Filed: Mar. 7, 2003

(65) Prior Publication Data

US 2003/0172798 A1 Sep. 18, 2003

(30) Foreign Application Priority Data

Mar. 18, 2002 (JP) ..... 2002-074374

(51) Int. Cl.[7] ..... G10H 7/00
(52) U.S. Cl. ..... 84/645
(58) Field of Search ..... 84/645, 600, 609, 84/610, 649, 2–5

(56) References Cited

U.S. PATENT DOCUMENTS 5,189,237 A 2/1993 Koguchi
5,648,621 A * 7/1997 Sasaki ..... 84/171
5,902,949 A * 5/1999 Mohrbacher ..... 84/609
6,281,424 B1 * 8/2001 Koike et al. ..... 84/636
6,380,473 B2 * 4/2002 Uehara ..... 84/609
6,489,549 B2 * 12/2002 Schmitz et al. ..... 84/609
6,600,097 B2 * 7/2003 Shiiya ..... 84/609

FOREIGN PATENT DOCUMENTS

EP 1 103 973 5/2001

* cited by examiner

*Primary Examiner*—Jeffrey Donels
(74) *Attorney, Agent, or Firm*—Morrison & Foerster LLP

(57) ABSTRACT

A user records a part of a piece of music performed on the composite audio system into and reproduces the performance from a floppy disc in ensemble with another part of the piece of music; while a compact disc player is producing an audio signal from audio data codes, the composite audio system produces event codes representative of local peaks in the audio signal for timing control, and stores these event codes together with event codes representative of note events and duration data codes in the floppy disc; while the composite audio system and compact disc player are reproducing the parts of the piece of music, the time intervals among the tones are prolonged and shrunk by using the event codes for timing control and actual local peaks so that the tones in one of the parts are produced synchronously with the tones of the other part.

29 Claims, 14 Drawing Sheets

RECORDER, METHOD FOR RECORDING MUSIC, PLAYER, METHOD FOR REPRODUCING THE MUSIC AND SYSTEM FOR ENSEMBLE ON THE BASIS OF MUSIC DATA CODES DIFFERENTLY FORMATTED

FIELD OF THE INVENTION

This invention relates to recording and playback technologies and, more particularly, to a recorder, a method for recording a piece of music, a player, a method for reproducing the piece of music and an ensemble system for an ensemble represented by plural sorts of music data codes differently formatted.

DESCRIPTION OF THE RELATED ART

Compact discs are popular to music lovers. Pieces of music are recorded in the compact discs, and are reproduced by a compact disc player. While a musician was playing the piece of music, the tones were converted to an analog audio signal, and discrete values were sampled from the analog audio signal. The discrete values were converted to binary values, and the binary values are stored in the compact disc in the form of digital codes together with control data codes representative of the lapse of time from the initiation of the performance. In the following description, the digital codes representative of the discrete values and control data codes representative of the lapse of time are referred to as "audio data codes." and "time data codes", respectively, and term "compact disc data codes" is indicative of both of the audio data codes and the time data codes.

Another sort of digital data codes popular to the music lowers is MIDI (Musical Instrument Digital Interface) music data codes. The MIDI music data codes are formatted on the basis of the MIDI standards, and event codes and duration data codes are typical examples of the format. The event codes mainly represent note events, i. e., note-on events and note-off events. A tone is generated in the note-on event, and the tone is decayed in the note-off event. The other event codes represent other sorts of events such as, for example, the end of a performance. The duration data code is indicative of the time interval between the note events. Thus, the duration data codes are produced on the basis of the definition different from that of the time data codes. A set of MIDI music data codes represents a piece of music, and the piece of music is reproduced through MIDI musical instruments.

The compact disc players are sold in the market, and the pieces of music are reproduced from the compact disc data codes stored in the compact discs. Similarly, various sorts of musical instruments are sold in the market, and the pieces of music are reproduced from the MIDI music data codes stored in floppy discs through the musical instruments. However, the compact disc player can not reproduce the pieces of music represented by the MIDI music data codes, and the user can not use the floppy discs in the playback of the pieces of music. In this situation, even if a part of a piece of music is recorded in a compact disc in the form of compact disc data codes and another part of the piece of music is recorded in a floppy disc in the form of MIDI music data codes, it is difficult to reproduce the plural parts of the piece of music through the compact disc player and the MIDI musical instrument in ensemble.

One of the problems is how to process the compact disc data codes and MIDI music data codes synchronously. As described hereinbefore, the time data codes represent the lapse of time from the initiation of the performance. On the other hand, each duration data code represents a time interval between the note events. The time at which tones are generated is differently controlled between a part of a piece of and another part of the piece of music. If a user wishes to reproduce the piece of music in ensemble, either time data codes or duration data codes are to be converted to the duration data codes or time data codes. However, the compact disc players presently sold in the market neither have any signal output port from which the time data codes are output to the outside nor any signal input port for receiving the duration data codes. Moreover, the compact disc player and MIDI musical instrument do not have any software for controlling the recording and playback on the basis of the other sort of time data.

In these circumstances, it is impossible to reproduce a part of a piece of music through the MIDI musical instrument in ensemble with another part of the piece of music reproduced through the compact disc player. When the user wishes to record his performance on the MIDI musical instrument in ensemble with the piece of music reproduced through the compact disc player, the duration data codes are produced independently of the time data codes, and the recorder of the MIDI musical instrument does not correlate the duration data codes with the time data codes.

SUMMARY OF THE INVENTION

It is therefore an important object of the present invention to provide a recorder, with which a sort of music data representative of a performance is recorded in ensemble with reproduction of a piece of music represented by another sort of music data.

It is also an important object of the present invention to provide a recording method, through which the recorder records the sort of music data in ensemble with the reproduction.

It is another important object of the present invention to provide a player, through which a performance represented by a sort of music data is reproduced in ensemble with reproduction of a piece of music represented by another sort of music data.

It is also an important object of the present invention to provide a playback method, through which the player reproduces the performance represented by the sort of music data in ensemble with the reproduction of the piece of music represented by another sort of music data.

It is yet another important object of the present invention to provide a synchronizer, which controls two tone generators for an ensemble on the basis of different sorts of music data.

In accordance with one aspect of the present invention, there is provided a recorder for recording a first passage in an information storage medium as pieces of first data in ensemble with a second passage produced on the basis of pieces of second data different in data format from the pieces of first data, and the recorder comprises a first analyzer analyzing an analog signal produced in response to a first clock signal for detecting at least one local peak of the analog signal and producing at least one piece of first timing data, a second analyzer analyzing the pieces of first data and the aforesaid at least one piece of first timing data for determining time intervals among the pieces of first data and the aforesaid at least one piece of first timing data and producing pieces of second timing data each representative of one of the time intervals as a number of clocks of a second clock signal without a guarantee that a frequency thereof is equal to a frequency of the first clock signal and a writer connected to the first analyzer, the second analyzer and a source of the pieces of first data and writing the at least one piece of first timing data, the pieces of first data and the pieces of second timing data in the information storage medium.

In accordance with another aspect of the present invention, there is provided a method for recording a performance along a first passage in an information storage medium as pieces of first data in ensemble with a second passage produced on the basis of pieces of second data different in data format from the pieces of first data, and the method comprises the steps of a) producing an analog signal representative of the second passage from the pieces of second data in response to a first clock signal, b) monitoring the analog signal to see whether or not a local peak occurs in the analog signal, c) producing a piece of first timing data when the local peak occurs, d) analyzing the piece of first timing data and the pieces of first data for producing a piece of second timing data representative of a time interval between the piece of first timing data and one of the pieces of first data and e) storing the piece of first timing data, the piece of second timing data and the pieces of first data in the information storage medium.

In accordance with yet another aspect of the present invention, there is provided a player for reproducing a first passage from pieces of first data in ensemble with a second passage produced on the basis of pieces of second data different in data format from the pieces of first data, the player comprises a first analyzer analyzing an analog signal produced from the pieces of second data in response to a first clock signal for detecting at least one local peak in the analog signal and producing a piece of first timing data representative of an occurrence of the at least one local peak, a data-to-sound converter for producing the first passage from the pieces of first data and a read-out device connected to the first analyzer and the data-to-sound converter and responsive to the piece of first timing data so as to start to read out the pieces of first data and the pieces of second timing data from the information storage medium, and the read-out device waits for the expiry of a time period defined by each piece of second timing data read out from the information storage medium as a number of clocks of a second clock signal without a guarantee that a frequency thereof is equal to a frequency of the first clock signal for transferring associated one of the pieces of first data to the data-to-sound converter when the time period is expired.

In accordance with still another aspect of the present invention, there is provided a method of reproducing a first passage from pieces of first data in ensemble with a second passage produced on the basis of pieces of second data different in data format from the pieces of first data comprising the steps of a) producing an analog signal representative of the second passage from the pieces of second data in response to a first clock signal, b) monitoring the analog signal to see whether or not a local peak occurs in the analog signal, c) producing a piece of first timing data when the local peak occurs, d) reading out a piece of second timing data representative of a time interval between a piece of first read-out timing data representative of the local peak in a recording and one of the pieces of first data and the aforesaid one of the pieces of first data from an information storage medium, and e) producing a tone or tones of the first passage on the basis of the aforesaid one of the pieces of first data when the time interval is expired.

In accordance with yet another aspect of the present invention, there is provided a composite audio system for recording a first passage in an information storage medium as pieces of first data in ensemble with a second passage represented by pieces of second data different in data format from the pieces of first data and reproducing the first passage in ensemble with the second passage; the composite audio system comprises a recorder including a first analyzer analyzing an analog signal produced in response to a first clock signal for detecting at least one local peak of the analog signal and producing at least one piece of first timing data in a recording, a second analyzer analyzing the pieces of first data and the aforesaid at least one piece of first timing data for determining time intervals among the pieces of first data and the aforesaid at least one piece of first timing data and producing pieces of second timing data each representative of one of the time intervals as a number of clocks of a second clock signal without a guarantee that a frequency thereof is equal to a frequency of the first clock signal and a writer connected to the first analyzer, the second analyzer and a source of the pieces of first data and writing the aforesaid at least one piece of first timing data, the pieces of first data and the pieces of second timing data in the information storage medium and a player including the first analyzer further analyzing the analog signal for detecting the aforesaid at least one local peak and producing the piece of first timing data representative of an occurrence of the aforesaid at least one local peak in a playback, a data-to-sound converter for producing the first passage from the pieces of first data transferred from the information storage medium and a read-out device connected to the first analyzer and the data-to-sound converter and responsive to the piece of first timing data so as start to read out the pieces of second timing data and the pieces of first data from the information storage medium, and the read-out device waits for the expiry of a time period defined by each piece of second timing data read out from the information storage medium as a number of clocks of a second clock signal without a guarantee that a frequency thereof is equal to a frequency of the first clock signal for transferring associated one or ones of the pieces of first data to the data-to-sound converter when the time period is expired.

BRIEF DESCRIPTION OF THE DRAWINGS

The features and advantages of the recorder, recording method, player, playback method and synchronizer will be more clearly understood from the following description taken in conjunction with the accompanying drawings, in which.

DESCRIPTION OF THE PREFERRED EMBODIMENTS

System Configuration

Figure 1:
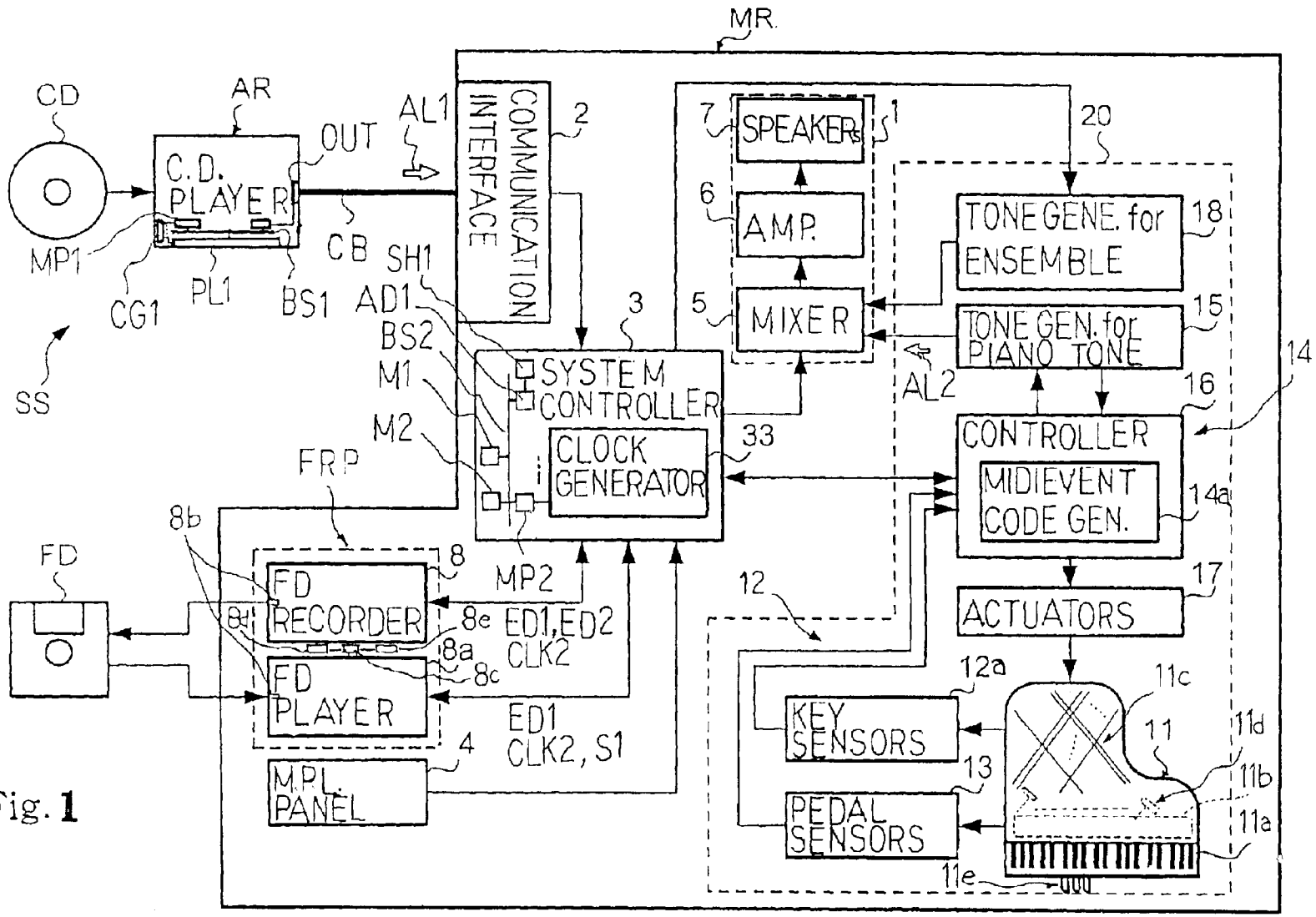
FIG. 1 is a block diagram showing the system configuration of a composite audio system according to the present invention.

Referring first to FIG. 1 of the drawings, a synchronous recorder/player system SS embodying the present invention largely comprises a compact disc player AR, a composite audio system MR for recording and reproducing the MIDI music data codes and a cable CB connected between the compact disc player AR and the composite audio system MR. Pieces of music have been recorded in compact discs CD, and are represented by sets of compact disc data codes. The compact discs CD are loaded into the compact disc player AR, and the pieces of music or music passages are selectively reproduced through the compact disc player AR. When a user requests the compact disc player AR to reproduce a piece of music, the compact disc player AR selects a set of compact disc data codes representative of the piece of music from the compact disc CD, and produces an analog audio signal AL1 from the audio data codes. The time data codes are periodically read out from the compact disc CD, and the compact disc player AR produces visual images representative of the lapse of time from the playback on a display window (not shown).

The compact disc player AR is of the standard model sold in the market, and does not have any output port assigned to the time data codes. However, the compact disc player AR has a signal output port OUT assigned to the analog audio signal AL1. In this instance, the cable CB is connected at one end thereof to the signal output port OUT so that the analog audio signal AL1 is transferred through the cable CB to the composite audio system MR. The composite audio system MR extracts pieces of timing data information from the analog audio signal AL1, and makes the composite audio system MR synchronized with the compact disc player AR.

The compact disc player AR includes a microprocessor MP1, a bus system BS1 and a manipulating panel PL1. The user gives his or her instructions through the manipulating panel PL to the compact disc player AR for a piece of music to be reproduced, volume, an initiation of the playback and an interruption of the playback. An analog audio signal representative of an original performance was sampled at a predetermined frequency, and the discrete values were converted to the audio data codes for recording the performance in the compact disc CD. The predetermined frequency is usually 44.1 kHz. For this reason, a clock generator CG1 is incorporated in the compact disc player AR, and generates a clock signal at the predetermined frequency, i.e., 44.1 kHz for restoring the analog audio signal. The clock signal used for restoring the analog audio signal is hereinbelow labeled with "CLK1" for discriminating it from other periodical signals. The microprocessor MP1 controls other system component with the clock signal CLK1. For example, the compact disc player AR reads out the audio data codes synchronously with the clock signal CLK1.

The composite audio system MR for recording and producing the MIDI music data codes includes a sound system 1, a communication interface 2, a system controller 3, a manipulating panel 4, a floppy disc recorder/player FRP and an automatic player piano 20. The cable CB is connected at the other end to the communication interface 2 so that the communication interface 2 receives the analog audio signal AL1. The system controller 3 is connected to the sound system 1, communication interface 2, manipulating panel 4, floppy disc recorder/player FRP and automatic player piano 20, and supervises those system components 1, 2, 4, FRP and 20.

A user gives his or her instructions to the composite audio system MR through the manipulating panel 4 for a synchronous recording, a synchronous playback and so forth. The user may instruct the composite audio system MR of a standard automatic playing. Thus, the synchronous recording and synchronous playback do not set any limit on the tasks achieved by the composite audio system MR. The system controller 3 periodically checks the manipulating panel 4 in an execution of a main routine program to see whether or not a user gives an instruction for a task. When the system controller 3 acknowledges user's instructions, the main routine program branches to a subroutine program for achieving the task. When the user instructs the system controller 3 of the synchronous recording, the system controller 3 analyzes the analog audio signal AL1 for extracting the timing for making a performance on the automatic player piano 20 synchronized with the playback through the compact disc player AR, and transfers the event codes representative of the performance on the automatic player piano 20 to the floppy disc recorder/player FRP for storing the event codes in a floppy disc FD together with the duration data codes. On the other hand, when the user instructs the system controller 3 of the synchronous playback, the system controller 3 also analyzes the analog audio signal AL1 for extracting the timing for making the playback through the automatic player piano 20 synchronized with the playback through the compact disc player AR, and supplies the analog audio signal and event codes to the sound system 1 and automatic player piano 20, respectively. The synchronous recording and synchronous playback will be hereinlater described in detail.

The system controller 3 includes a central processing unit MP2, a program memory M1, a working memory M2, a bus system BS2, a sample-and-hold circuit SH1, an analog-to-digital converter AD1, a clock generator 33 and signal interfaces. The central processing unit MP2, memories M1/M2 and signal interfaces are connected to the bus system BS2 so that signals are transferred from the signal interfaces to the central processing unit and vice versa and between the central processing unit MP2 and the memories M1/M2 through the bus system BS2. The interfaces are connected to the sound system 1, communication interface 2, manipulating panel 4, floppy disc recorder/player FRP and automatic player piano 20.

Though not shown in the drawings, the clock generator 33 includes a quartz oscillator, an amplifier and a frequency divider. The quartz oscillator generates a periodic signal at a certain frequency, and the oscillating signal is amplified through the amplifier. Several clock signals are produced from the amplified periodic signal in the frequency divider, and are output from the clock generator 33. One of the clock signals is called as "tempo clock CLK2", and the time intervals between the events are defined by using the tempo clock CLK2. The sample-and-hold circuit SH1 and analog-to-digital converter AD1 will be hereinlater described in detail in conjunction with a subroutine program at a timer interruption with reference to FIG. 2.

The main routine program and subroutine programs are stored in the program memory M1, and the working memory M2 offers data storage areas, a flag area and a register area to the central processing unit MP2. Various jobs are achieved by the central processing unit MP2 through the execution of the programs. Moreover, the system controller 3 transfers the analog audio signal AL1 to the sound system 1 for converting the analog audio signal AL1 to tones and sound. The other jobs for the analysis on the analog audio signal, synchronous recording and synchronous playback will be hereinlater described in conjunction with the computer programs.

The sound system 1 includes a mixer 5, an amplifier 6 and loud speakers 7. The analog audio signal AL1 and other audio signals are supplied from the system controller 3 and automatic player piano 20 to the mixer 5. The audio signals are mixed with one another, and the mixed signal is equalized and amplified through the amplifier 6. The amplified signal is supplied from the amplifier 6 to the loud speakers 7, and the tones and sound are radiated from the loud speakers 7.

The automatic player piano 20 includes an acoustic piano 11, a data generating system 12 and an automatic playing system 14. In this instance, the acoustic piano 11 is a standard grand piano. An upright piano may serve as the acoustic piano 20 in another composite audio system MR according to the present invention. The data generating system 12 monitors the acoustic piano 11, and produces the event codes representative of the note events and pedal actions. Thus, the data generating system 12 cooperates with the acoustic piano 11 for storing a performance on the acoustic piano 11 in a set of event codes. On the other hand, the automatic playing system 14 reproduces the performance on the basis of the event codes. The user has an option between acoustic piano tones and electronic piano tones. The acoustic piano tones are produced through the acoustic piano 11, and the electronic piano tones are produced through the sound system 1.

The acoustic piano 11 includes a keyboard 11*a*, action units 11*b*, strings 11*c*, hammers 11*d* and pedals 11*e*. These component parts 11*a* to 11*e* are well known to skilled person, and no further description is hereinbelow incorporated for the sake of simplicity. While a user is fingering on the keyboard 11*a*, the associated action units 11*b* are actuated, and drive the associated hammers 11*d* for rotation. The hammers 11*d* strike the associated strings 11*c* at the end of the rotation, and give rise to vibrations of the strings 11*c*. The acoustic piano tones are radiated from the vibrating strings 11*c*. When the user steps on the pedals 11*e*, the acoustic piano tones are prolonged, lessened in volume and individually prolonged. Thus, the user changes the attributes of the acoustic piano tones through the pedal actions.

The data generating system 12 includes key sensors 12*a*, pedal sensors 13 and a controller 16. A MIDI event code generator 14*a* is incorporated in the controller 16. Although the MIDI event code generator 14*a* is exclusively used for producing the event codes, the data processing section of the controller 16 is shared with the automatic playing system 14. The key sensors 12*a* monitor the black/white keys of the keyboard 11*a*, and supply key position signals representative of the current key positions of the associated black/white keys to the controller 16. On the other hand, the pedal sensors 13 monitor the pedals 11*e*, and supply pedal position signals representative of the current pedal positions to the controller 16. The controller 16 periodically samples the key position signals and pedal position signals, and checks the current key positions/current pedal positions to see whether or not the user moves the black/white keys and pedals.

Figure 2:
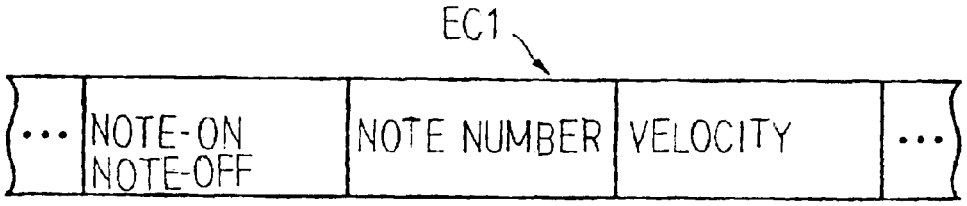
FIG. 2 is a view showing the format for an event code.

When the controller 16 acknowledges a depressed key, the controller 16 specifies the depressed key, and calculates the key velocity on the basis of the variance of the current key position. Similarly, when the controller acknowledges a released key, the controller 16 specifies the released key. Thus, the event code for the note event carries the note event, i.e., note-on or note-off, note number and velocity as shown in FIG. 2. On the other hand, when the pedal sensors 13 acknowledges that the user steps on a pedal, the controller 16 specifies the pedal 11*e*, and determines the stroke over which the pedal 11*e* is sunk. These pieces of music data information are supplied to the MIDI event code generator 14*a*. The MIDI event code generator 14*a* produces the event codes representative of those pieces of music data information, and supplies them to the system controller 3. In case where the user instructs the controller 16 to supply the event codes to the tone generator for piano tone 15. The tone generator for piano tone 15 generates an analog audio signal AL2 on the basis of the event codes, and supplies it to the sound system 1. The electronic piano tones are generated through the sound system 1, and the user confirms his or her performance through the electronic piano tones.

Turning back to FIG. 1, the automatic playing system 14 includes the controller 16, solenoid-operated actuators 17, a tone generator for electronic piano tones and a tone generator for ensemble 18. The solenoid-operated actuators 17 are associated with the black/white keys and pedals 11*e*, and the controller 16 selectively energizes the solenoid-operated actuators 17 for moving the black/white keys and pedals 11*e* without the fingering and steps of a human player.

The user is assumed to select the acoustic piano tones. When the controller 16 receives an event code representative of the note-on, the controller 16 specifies the black/white key to be moved, and determines the magnitude of the driving signal appropriate to the key velocity. The controller 16 supplies the driving signal to the actuator 17 associated with the black/white key to be moved. The actuator 17 gives rise to the key motion from the rest position toward the end position, and depressed key makes the associated action unit 11*b* drive the hammer 11*d* for rotation. The hammer 11*d* strikes the string 11*c* at the end of the rotation, and the acoustic piano tone is generated from the vibrating string 11*c*. The solenoid-operated actuator keeps the depressed key in the vicinity of the end position. When the event code representative of the note-off reaches the controller 16, the controller 16 decays the driving signal so that the depressed key returns to the rest position. If the event code requests the controller 16 to depress or release the pedal 11*e*, the controller 16 energizes the associated solenoid-operated actuator 17 or removes the driving signal from the associated solenoid-operated actuator 17 so that the pedals 11*e* are depressed and released as if a human player does it.

On the other hand, if the user selects the electronic piano tones, the controller 16 supplies the event codes to the tone generator for piano tone 15. A waveform memory is incorporated in the tone generator for piano tone 15, and pieces of waveform data are read out from the waveform memory on the basis of the event code. A digital audio signal is produced from the pieces of waveform data, and is converted to the analog audio signal AL2. The analog audio signal AL2 is supplied from the tone generator for piano tone 15 to the sound system 1. Thus, the electronic piano tones are generated through the sound system 1.

The tone generator for ensemble 18 also includes a waveform memory, and the event codes are supplied from the system controller 3 to the tone generator for ensemble 18. The tone generator for ensemble 18 produces a digital audio signal on the basis of the event codes, and supplies it to the mixer 5. The digital audio signal is converted to an analog audio signal, and the mixer 5 mixes the analog audio signals in the mixed signal prior to the amplification in the amplifier 6.

The floppy disc recorder/driver FRP is a composite apparatus, which includes a floppy disc recorder 8 and a floppy disc player 8*a*. The floppy disc recorder 8 and floppy disc player 8*a* includes a read/write head 8*b*, a microprocessor 8*c*, a program memory 8*d*, a working memory 8*e* and a bus system. A main routine program, a subroutine program for the synchronous recording and a subroutine program for the synchronous playback are stored in the program memory 8*d*. The microprocessor 8*c* repeatedly executes the main routine program, and waits for instructions of the system controller 3. The system controller 3 activates the floppy disc recorder 8 in the synchronous recording and the floppy disc player 8*a* in the synchronous playback. In other words, the system controller 3 makes the main routine program executed by the microprocessor 8*c* selectively branch to the subroutine program for the synchronous recording and the subroutine program for the synchronous playback.

While the microprocessor 8*c* is executing the subroutine program for the synchronous recording, the MIDI event code generator 14*a* intermittently supplies event codes ED1 representative of note events and pedal events through the system controller 3 to a data port, and the system controller 3 also intermittently supplies event codes ED2 for timing control to the data port. When an event code arrives at the data port, the microprocessor 8*c* starts an internal clock, and waits for the next event code. The internal clock counts up the tempo clocks CLK2. When the next event code reaches the data port, the microprocessor 8*c* stops the internal clock, and determines the time interval between the previous event and the event. The microprocessor 8*c* produces a duration data code representative of the time interval as the number of the tempo clocks CLK2. The floppy disc recorder 8 creates standard MIDI files SMF in a floppy disc FD, and stores the event codes ED1/ED2 and duration data codes, i.e., a set of MIDI music data codes representative of the piece of music in the standard MIDI file SMF.

While the microprocessor 8*c* is executing the subroutine program for the synchronous playback, the microprocessor 8*c* intermittently reads out the event code and associated duration data code. The microprocessor 8*c* stores the duration data code in an internal register, and decrements the number of tempo clocks indicated by the duration data code in response to the tempo clocks CLK2. When the number stored in the internal register reaches zero, the microprocessor 8*c* transfers the event code or codes ED1 to the system controller 3. If the event code for timing control is read out from the floppy disc, the microprocessor 8*c* makes the data read-out from the floppy disc FD synchronous with the corresponding local peak of the analog audio signal AL1 as will be described hereinlater in detail.

Figure 3:
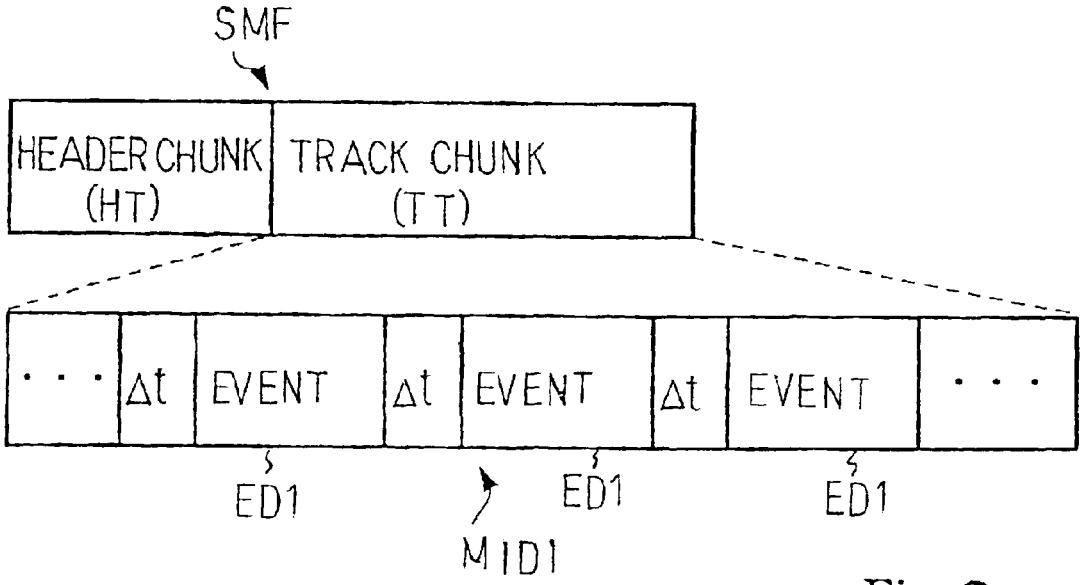
FIG. 3 is a view showing the data structure of a standard MIDI file.

FIG. 3 shows the standard MIDI file SMF. A header chunk HT and a track chunk TT as a whole constitute the standard MIDI file SMF. Pieces of control data information such as, for example, a chunk type are stored in the header chunk HT, and a set of MIDI music data codes MIDI are stored in the track chunk TT. As described hereinbefore, the event codes EC1 representative the note events, other event codes and duration data codes Δt form in combination the set of MIDI music data codes MIDI. As will be described in conjunction with a subroutine program at every timer interruption, event codes ED2 for timing control are inserted into the set of MIDI music data codes MIDI, and the event codes ED2 for timing control make the playback through the automatic player piano 20 synchronous with the playback through the sound system 1. The event codes ED2 for timing control are produced by the system controller 3.

The tempo clock CLK2 is supplied from the clock generator 33 to the floppy disc recorder 8. The floppy disc recorder 8 counts the tempo clocks between a note event or events and the previous note event, and determines the time interval expressed by the number of tempo clocks CLK2. The floppy disc recorder 8 produces the duration data codes each representative of the time interval between the note events. Thus, the floppy disc recorder 8 internally produces the duration data codes.

The event codes representative of the note events ED1 are supplied from the MIDI event code generator 14*a* through the system controller 3, and the event codes for timing control are directly supplied from the system controller 3. The floppy disc recorder 8 stores the event codes ED1, event codes for timing control and duration data codes in the track chunk TT. Thus, the floppy disc recorder 8 records a performance on the acoustic piano 11 in a floppy disc in such a manner that the automatic player piano 20 reproduces the performance in ensemble with the compact disc player AR in the synchronous playback.

On the other hand, the floppy disc player 8*a* sequentially reads out the MIDI music data codes MIDI from the floppy disc FD, and supplies the MIDI music data codes to the system controller 3. The tempo clock CLK2 is also supplied from the clock generator 33 to the floppy disc player 8*a*. When the floppy disc player 8*a* reads out a duration data code, the floppy disc player 8*a* makes the read/write head 8*b* enter waiting state, and keeps the read/write head 8*b* standing idle for the time period indicated by the duration data code. While the floppy disc player 8*a* is waiting for the expiry of the time period, the floppy disc player 8*a* counts down the number of tempo clocks CLK2 indicated by the duration data code. When the number reaches zero, the time period is expired, and the floppy disc player 8*a* supplies the event code or codes ED1 to the system controller 3, and reads out the next event code or codes together with the associated duration data code from the floppy disc FD. Thus, the floppy disc player 8*a* intermittently reads out the event code or codes ED1 from the floppy disc FD, and transfers the event code or codes ED1 to the system controller 3.

When the floppy disc player 8*a* reads out the event code ED2 for timing control from the track chunk TT, the floppy disc player 8*a* checks a control signal representative of a notice of a peak in the analog audio signal AL1 to see whether or not the playback of the performance is synchronized with the playback of the piece of music on the basis of the audio data codes. When the piano tones are considered to be well ensembled with the electric tones produced from the analog audio signal AL1, the floppy disc player 8*a* continues to intermittently read out the MIDI music data codes. However, if the piano tones and electric tones are out of the synchronization, the floppy disc player 8*a* prolongs or shrinks the time interval so as to establish the automatic player piano 20 in the synchronous state with the compact disc player AR. The synchronization on the basis of the event codes for timing control will be described in conjunction with computer programs.

Computer Programs

The system controller 3 repeatedly executes a main routine program. The system controller 3 periodically checks the manipulating panel 4 during the execution of the main routine program to see whether or not a user gives instructions for tasks. When the user instructs the system controller 3 of the synchronous recording or synchronous playback, the central processing unit MP2 sets the flag FG1 to a value representative of the synchronous recording or synchronous playback, and the main routine program branches to the subroutine program for the synchronous recording or synchronous playback. The system controller 3 receives the analog audio signal AL1, and transfers it to the mixer 5. The analog audio signal AL1 is supplied to the sample-and-hold circuit SH1. The sample-and-hold circuit SH1 is responsive to the sampling clock signal so as to sample a momentary value of the analog audio signal. The momentary value is supplied to the analog-to-digital converter AD1, and is converted to a digital data code D1 representative of a binary value BN1 equivalent to the momentary value.

Figure 4:
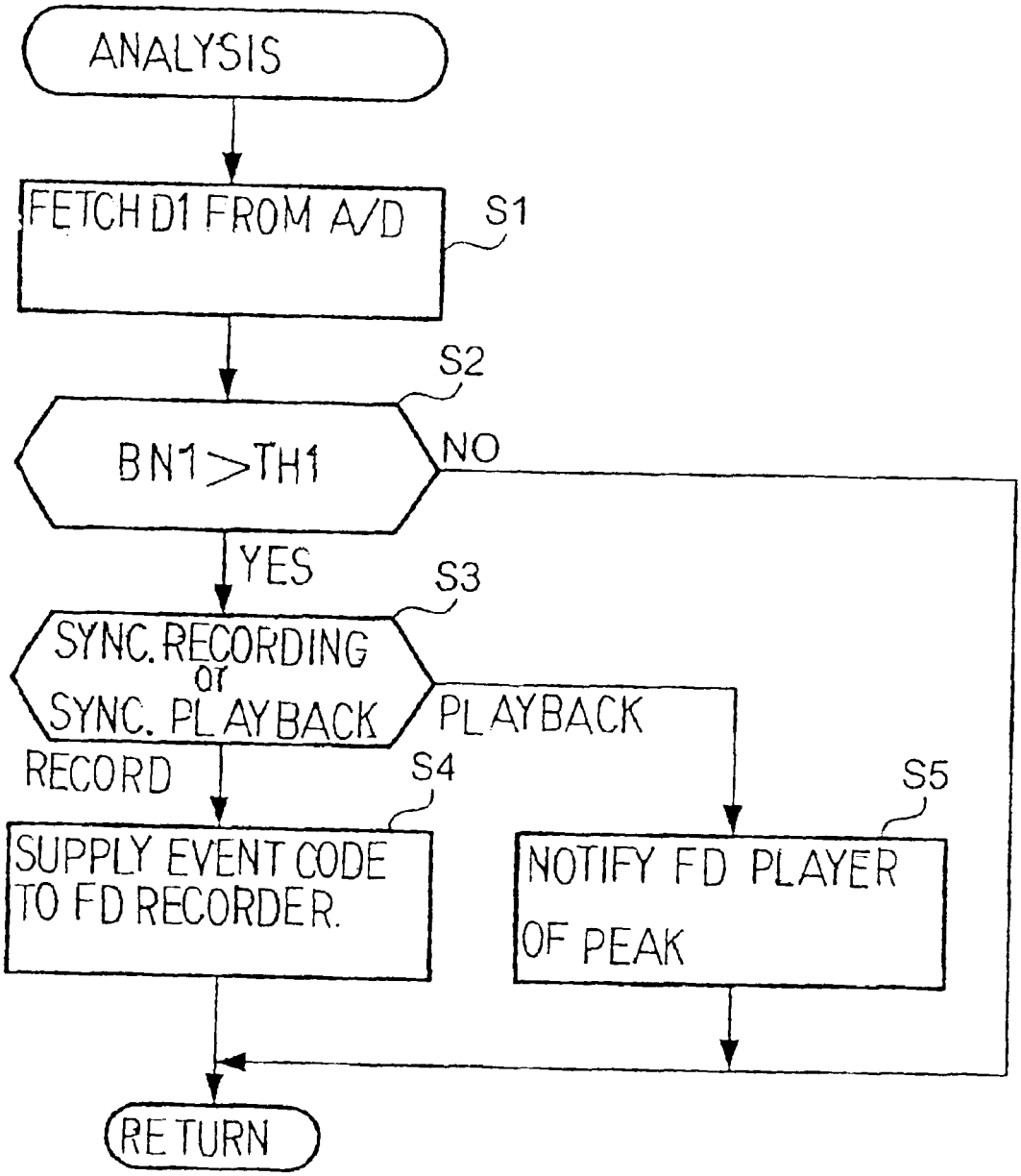
FIG. 4 is a flowchart showing an analysis on an analog audio signal reproduced from audio data codes stored in a compact disc.

While the central processing unit MP2 is executing the programmed instructions in the subroutine program for the synchronous recording or synchronous playback, a timer interruption periodically takes place, and the subroutine program branches to a computer program shown in FIG. 4.

Upon entry into the computer program at every timer interruption, the central processing unit MP2 fetches the digital data code D1 from the analog-to-digital converter AD1 as by step S1, and compares the binary value BN1 with a threshold value TH1 to see whether or not the binary value BN1 is greater than the threshold value TH1 as by step S2. The threshold value TH1 is representative of a local peak of the analog audio signal AL1.

Figure 5:
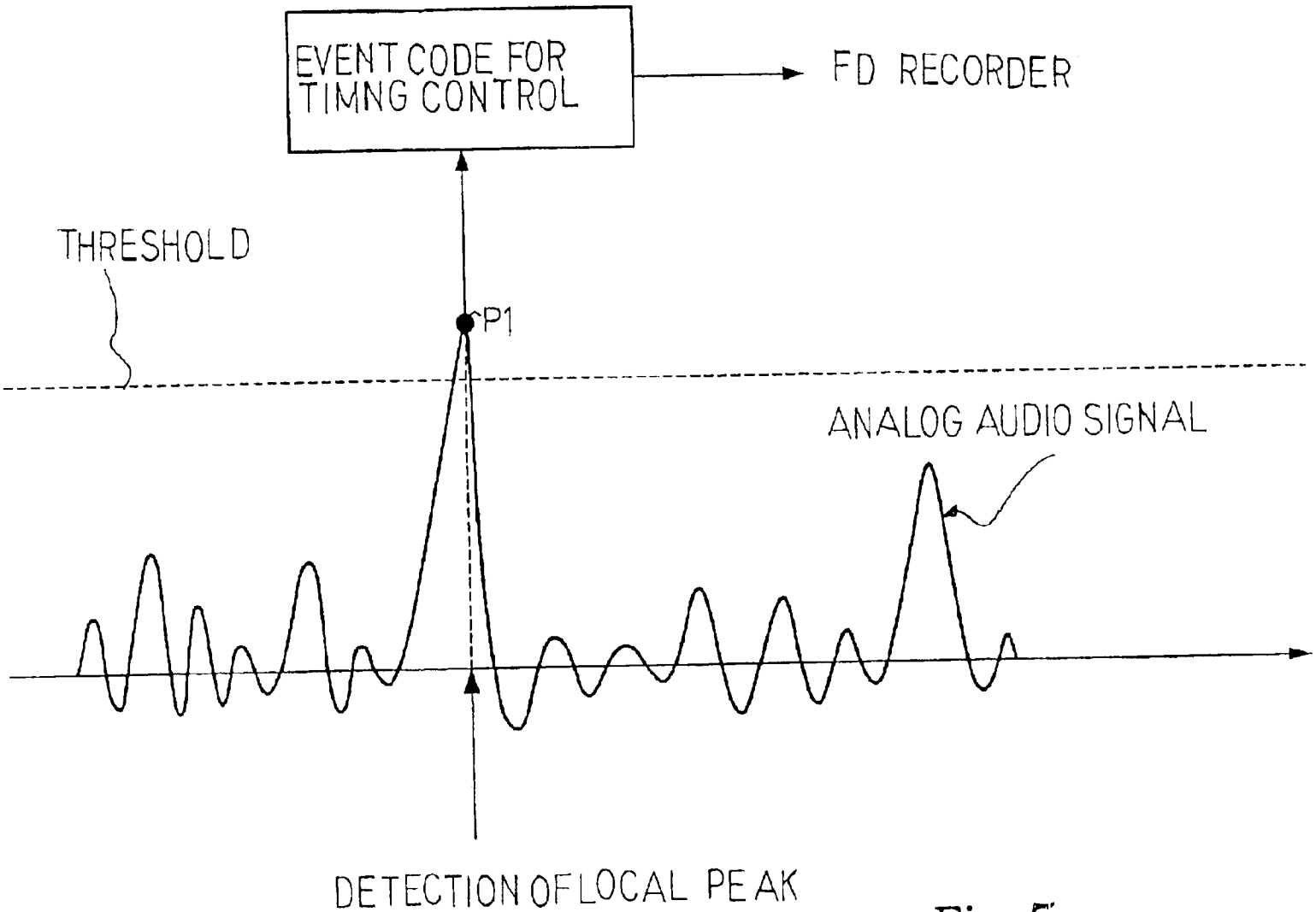
FIG. 5 is a view showing a waveform of the analog audio signal and a local peak.

When the binary value BN1 is greater than the threshold value TH1, the answer at step S2 is given affirmative "YES", and the central processing unit MP2 presumes the momentary value to be sampled at a local peak P1 of the analog audio signal AL as shown in FIG. 5. When the analog audio signal AL1 locally peaks the magnitude, the time at which the magnitude is peaked serves as a mark in the music passage. Using the marks, the composite audio system MR makes the music passage reproduced from the MIDI music data codes synchronous with the music passage reproduced form the compact disc data codes. When the central processing unit MP2 finds the analog audio signal AL1 peaked at the binary value BN1, the central processing unit MP2 proceeds to step S3.

On the other hand, if the binary value BN1 is equal to or less than the threshold value TH1, the central processing unit MP2 immediately returns to the subroutine program for the synchronous recording or synchronous playback with the negative answer "NO".

The central processing unit checks the flag FG1 to see whether the user instructed the system controller 3 of the synchronous recording or synchronous playback at step S3. When the flag FG1 is indicative of the synchronous recording, the central processing unit MP2 proceeds to step S4. The central processing unit MP2 produces an event code ED2 for timing control, and supplies the event code to the floppy disc recorder 8. The event code ED2 is indicative of the time at which the magnitude exceeds the threshold value TH1. As will be described hereinlater, the floppy disc player 8*a* makes a music passage reproduced from the floppy disc FD synchronous with another music passage reproduced from the compact disc CD by using the event codes ED2 for timing control as marks.

On the other hand, if the flag FG1 is indicative of the synchronous playback, the central processing unit MP2 notifies the floppy disc player 8*a* of the detection of the peak through a control signal S1 as by step S5. Upon completion of the job at step S4 or S5, the central processing unit MP2 returns to the subroutine program for the synchronous recording or synchronous playback. Thus, the system controller 3 monitors the analog audio signal AL1, and detects the local peaks of the analog audio signal AL1 in the synchronous recording and synchronous playback.

Synchronous Recording and Synchronous Playback

Figure 6:
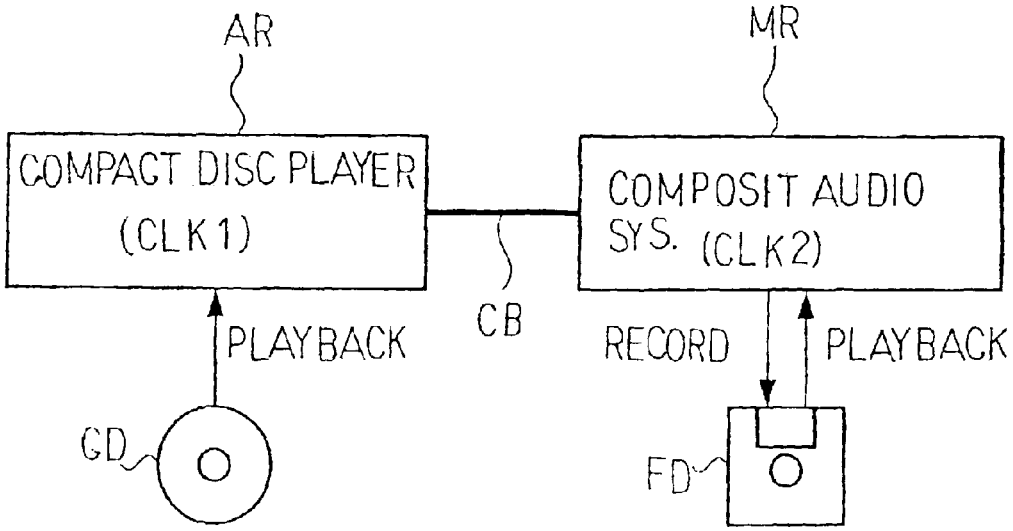
FIG. 6 is a block diagram showing a synchronous recording and a synchronous playback through a compact disc player and the composite audio system.

While the floppy disc recorder 8 is recording a performance on the acoustic piano 11, the system controller 3 transfers the tempo clocks CLK2, the event codes ED1 representative of the note events and event codes ED2 for timing control to the floppy disc recorder 8, and the floppy disc recorder 8 stores the event codes ED1/ED2 in the track chunk TT together with the duration data codes defined as the number of tempo clocks CLK2. On the other hand, the clock generator CG1 produces the clock signal CLK1, and the compact disc player AR reproduces the compact disc data codes on the basis of the clock signal CLK1, and restores the audio data codes to the analog audio signal AL1. The clock signal CLK1 is usually different in frequency to the tempo clock CLK2, and only the analog audio signal AL1 is output from the compact disc player AR. Thus, although the compact disc player AR is connected through the cable CB to the composite audio system MR, the compact disc player AR and composite audio system MR independently define their behaviors with the clock signals CLK1 and CLK2 different in frequency as shown in FIG. 6. Using the composite audio system MR, a piece of music or a music passage is reproduced from the MIDI music data codes in ensemble with a piece of music reproduced from the audio data codes through several ways as follows.

First Role of Peak

Figure 7:
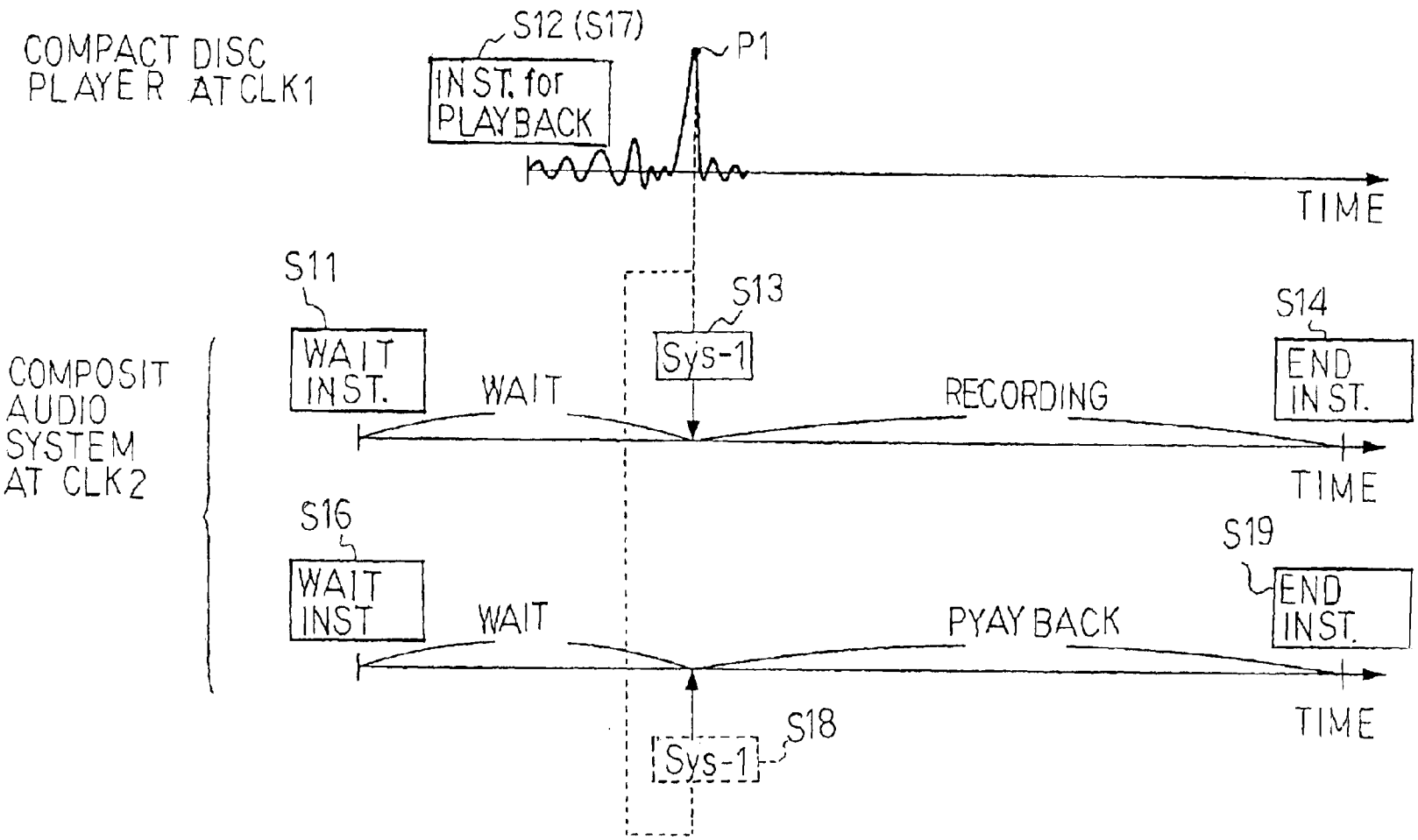
FIG. 7 is a timing chart showing the first role of a peak in an analog audio signal in the synchronous recording and synchronous playback.

FIG. 7 shows a sequence of the synchronous recording and synchronous playback. First, the user carries out preparatory works. The user connects the composite audio system MR to the compact disc player AR by using the cable CB (see FIG. 6), and loads a compact disc CD, in which a piece of music to be reproduced has been already recorded, and a blank floppy disc FD into the compact disc player AR and the floppy disc recorder 8, respectively.

Subsequently, the user gives a wait instruction to the system controller 3 through the manipulating panel 4 as by step S11. Then, the composite audio system MR enters the waiting state, and the system controller 3 starts to make the main routine program branch to the subroutine program for the synchronous recording. The system controller 3 periodically enters the subroutine program shown in FIG. 4 at every timer interruption, and checks the output port of the analog-to-digital converter AD1 for a peak P1. The floppy disc recorder 8 creates the standard MIDI file SMF in the floppy disc FD, if necessary.

The user gives an instruction for the playback to the compact disc player AR as by step S12. The compact disc player AR starts to read out the compact disc data codes from the compact disc CD. The compact disc player AR is responsive to the clock signal CLK1 so as to produce the analog audio signal AL1 from the read-out audio data codes. The analog audio signal AL1 is transferred from the output port OUT through the cable CB to the communication interface 2. The analog audio signal AL1 is further transferred from the communication interface 2 to the system controller 3. The system controller 3 transfers the analog audio signal AL1 to the mixer 5, and compares the momentary values of the analog audio signal AL1 with the threshold TH1 to see whether or not the analog audio signal AL1 locally peaks the magnitude as described hereinbefore.

When the system controller 3 finds the peak P1, the system controller 3 produces the event code ED2 (Sys-1) for timing control, and supplies the event code ED2 (Sys-1) to the floppy disc recorder 8 as by step S13. Then, the floppy disc recorder 8 automatically starts to store the event codes ED2/ED1 and duration data codes in the track chunk TT of the standard MIDI file SMF.

In detail, the user performs a piece of music on the acoustic piano 11 in ensemble with the piece of music radiated from the loud speakers 7, and the MIDI event code generator 14*a* produces and transfers the event codes ED1 through the system controller 3 to the floppy disc recorder 8. The floppy disc recorder 8 waits for the expiry of the time interval between the previous note event and a new event, and produces the duration data code for the time interval defined as the number of the tempo clocks CLK2. Thus, the floppy disc recorder 8 stores the event codes ED1/ED2 and duration data codes in the track chunk TT in order of arrival.

When the user finishes the performance, the user gives an end instruction to the system controller 3 through the manipulating panel 4 as by step S14. Then, the system controller 3 instructs the floppy disc recorder 8 to complete the recording, and the floppy disc recorder 8 stores an event code representative of the end of the performance at the end of the series of MIDI music data codes.

The user is assumed to wish to reproduce his or her performance stored in the floppy disc FD in ensemble with the compact disc player AR. The user loads the floppy disc FD and compact disc CD into the floppy disc player 8*a* and compact disc player AR, respectively, and gives a wait instruction to the system controller 3 as by step S16. The system controller 3 starts to make the main routine program branch to the subroutine program for the synchronous playback. The system controller 3 periodically enters the subroutine program at every timer interruption.

Subsequently, the user gives the instruction for the playback to the compact disc player AR as by step S17. Then, the compact disc player AR starts to read out the compact disc data codes in response to the clock signal CLK1, and produces the analog audio signal AL1 from the audio data codes. The analog audio signal AL1 is supplied through the cable CB and communication interface 2 to the system controller 3. The system controller 3 transfers the analog audio signal AL1 to the mixer, and checks the digital data codes sampled from the analog audio signal AL1 to see whether or not the momentary value exceeds the threshold value TH1 at every timer interruption.

When the system controller 3 finds the peak P1, the system controller 3 notifies the floppy disc player 8*a* of the peak P1 through the control signal as by step S18. Then, the floppy disc player 8*a* starts to read out the MIDI music data codes from the floppy disc FD. The first read-out code is the event code ED2 (Sys-1) for timing control, and the event codes ED1 and duration codes follow. The floppy disc player 8*a* waits for the expiry of the time interval between the note events by using the tempo clock CLK2, and intermittently transfers the event codes representative of the note events through the system controller 3 to the automatic player piano 20. The analog audio signal AL1 is amplified, and is converted to the electric tones through the loud speakers 7.

The controller 16 specifies the black/white keys to be moved, and determines the target key velocity. The controller 16 energizes the solenoid-operated actuators associated with the black/white keys to be depressed, and removes the driving signal from the solenoid-operated actuators associated with the black/white keys to be released. The acoustic piano tones are generated from the vibrating strings 11*c*, and the associated dampers make the vibrations decayed. When the event codes ED1 request the controller 16 to move the pedals 11*e*, the controller 16 energizes the solenoid-operated actuators associated with the pedals 11*e* so as to impart the effects to the acoustic piano tones. Thus, the automatic playing system 14 reproduces the acoustic piano tones in ensemble with the compact disc player/sound system AR/1.

When the last event code representative of the end of performance reaches the controller 16, the controller 16 terminates the reproduction. The user gives the instruction representative of the completion of the synchronous playback to the system controller 3 as by step S19. Then, the system controller 3 reiterates the main routine program, and waits for the next instruction.

As will be understood from the foregoing description, the composite audio system MR according to the present invention starts the recording at the detection of the peak P1 and the playback at the notice of the detection of peak P1. The peak P1 takes place at the same timing between the recording and the playback in so far as the compact disc player AR reads out the audio data codes representative of the same music. In other words, the system controller 3 gives the start timing to the floppy disc recorder/player 8/8*a* at the predetermined lapse of time from the initiation of the reproduction of the piece of music. Thus, the composite audio system MR starts the playback of the piece of music through the automatic player piano 20 at the certain timing in the playback of the pieces of music through the compact disc player/sound system AR/1.

If the user changes the volume of the electric tones between the recording and the playback, the system controller 3 can not exactly detect the peak P1. For this reason, the composite audio system MR may automatically set the compact disc player AR to the volume in the recording. Otherwise, the composite audio system MR may give a message to the user for the volume.

Second Role of Peaks

As described hereinbefore, the first role of the peak is to give the start timing to the composite audio system MR, and, accordingly, only one peak P1 is required. In the second role, plural peaks make the composite audio system MR synchronized with the compact disc player AR.

Figure 8A:
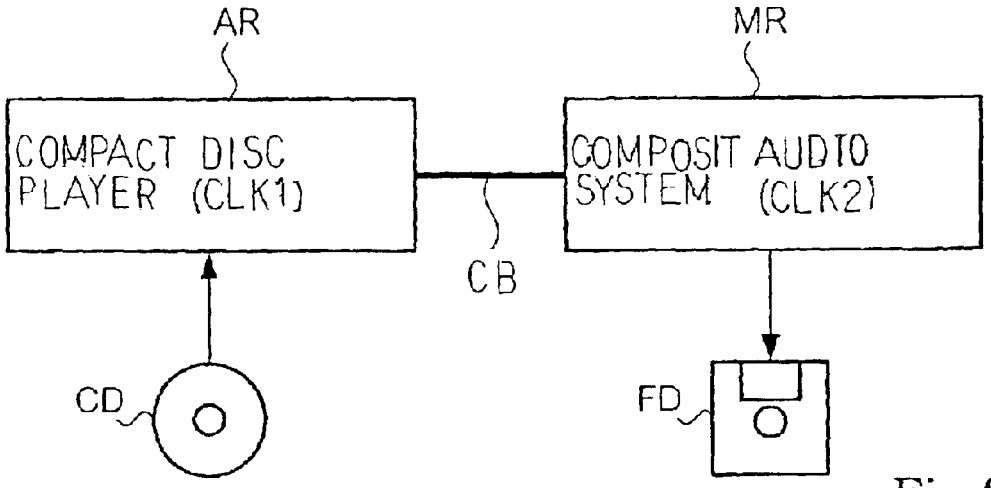
FIG. 8A is a block diagram showing the synchronous recording through the compact disc player and the composite audio system.
Figure 8B:
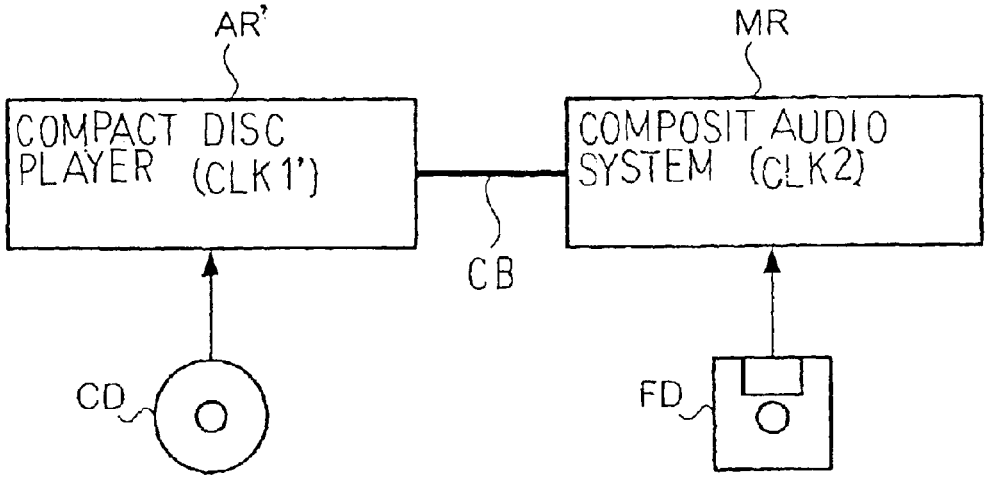
FIG. 8B is a block diagram showing another synchronous playback through another compact disc player and the composite audio system.

FIGS. 8A and 8B show the compact disc players AR/AR' and composite audio system MR connected through the cable CB for the synchronous recording and synchronous playback. In the synchronous recording, the compact disc player AR reads out the compact disc data codes from a compact disc CD in response to the clock signal CLK1, and the composite audio system MR records the MIDI music data codes in a floppy disc FD by using the tempo clock CLK2 for defining the time intervals. However, the compact disc player AR is replaced with a compact disc player AR' for the synchronous playback. The compact disc player AR' internally generates a clock signal CLK1', which is higher in frequency than the clock signal CLK1, and reads out the compact disc data codes from the compact disc CD in response to the high frequency clock signal CLK1'.

Figure 9:
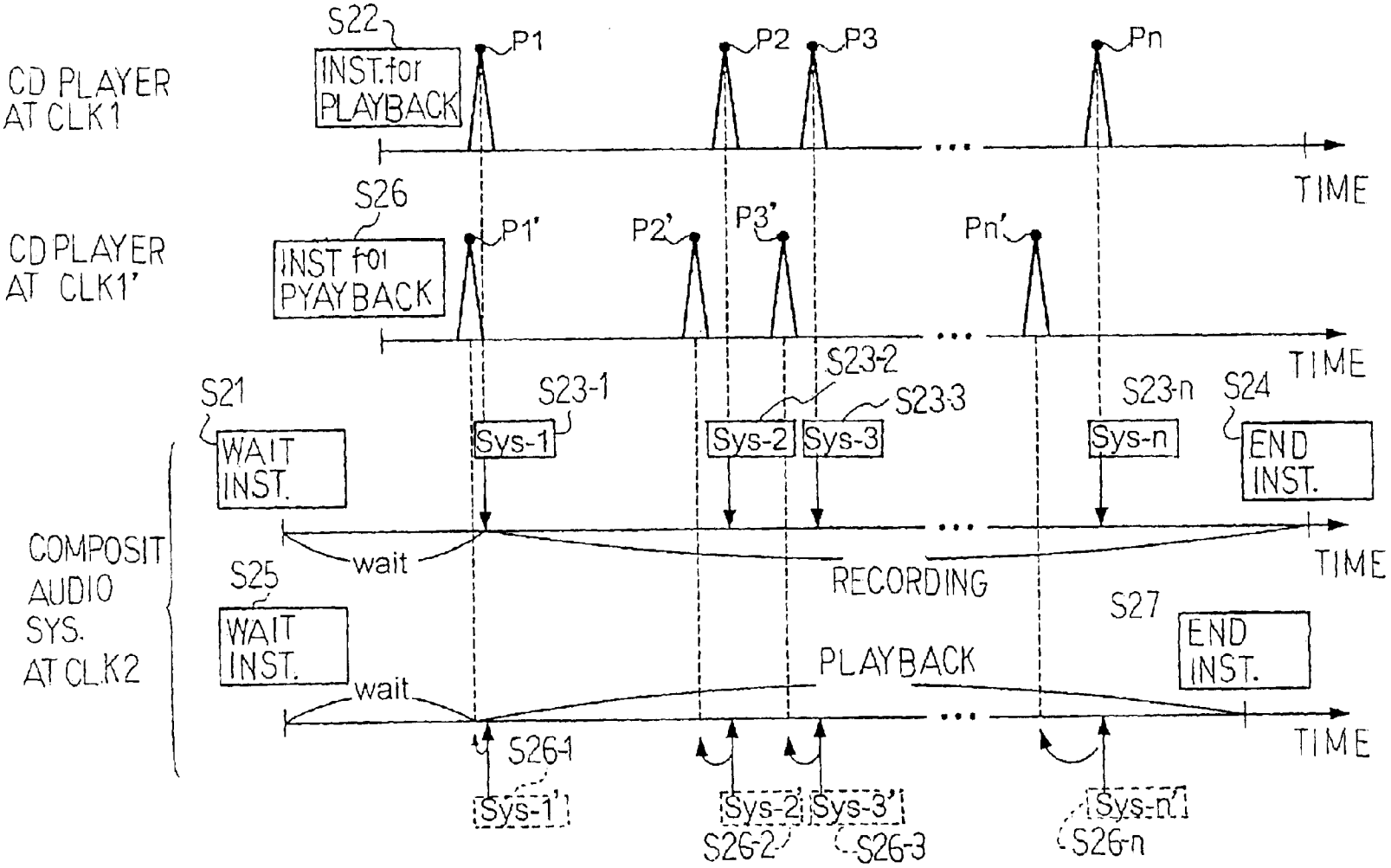
FIG. 9 is a timing chart showing the second role of peaks in an analog audio signal in the synchronous recording and synchronous playback.

FIG. 9 shows a sequence of the synchronous recording through the system shown in FIG. 8A and a sequence of the synchronous playback through the system shown in FIG. 8B. The preparatory works are similar to those described in conjunction with the first role.

Upon completion of the preparatory works, the user gives a wait instruction to the composite audio system MR as by step S21. Then, the main routine program starts to branch to the subroutine program for the synchronous recording, and the central processing unit MP2 enters a subroutine program shown in FIG. 10 at every timer interruption.

Subsequently, the user gives an instruction for playback to the compact disc player AR as by step S22. The compact disc player AR starts to read out the compact disc data codes in response to the clock signal CLK1, and produces the analog audio signal AL1 from the audio data codes. The analog audio signal AL1 is transferred from the compact disc player AR through the cable CB to the composite audio system MR, and the system controller 3 periodically checks the momentary values of the analog audio signal AL1 for a peak through the subroutine program shown in FIG. 10.

Upon entry into the computer program at every timer interruption, the central processing unit MP2 fetches the digital data code D1 from the analog-to-digital converter AD1 as by step S31, and compares the binary value BN1 with a threshold value TH1 to see whether or not the binary value BN1 is greater than the threshold value TH1 as by step S32. The threshold value TH1 is representative of a local peak of the analog audio signal AL1.

When the binary value BN1 is greater than the threshold value TH1, the answer at step S32 is given affirmative "YES", and the central processing unit MP2 presumes the momentary value to be sampled at a local peak of the analog audio signal AL1. When the analog audio signal AL1 locally peaks the magnitude, the time at which the magnitude is peaked serves as a mark in the music passage. Using the marks, the composite audio system MR makes the music passage reproduced from the MIDI music data codes synchronous with the music passage reproduced form the compact disc data codes. When the central processing unit MP2 finds the analog audio signal AL1 peaked at the binary value BN1, the central processing unit MP2 proceeds to step S33.

On the other hand, if the binary value BN1 is equal to or less than the threshold value TH1, the central processing unit MP2 immediately returns to the subroutine program for the synchronous recording or synchronous playback with the negative answer "NO".

The central processing unit checks the flag FG1 to see whether the user instructed the system controller 3 of the synchronous recording or synchronous playback at step S33. When the flag FG1 is indicative of the synchronous recording, the central processing unit MP2 proceeds to step S34. The central processing unit MP2 produces the event code ED2 for timing control, and supplies the event code ED2 to the floppy disc recorder 8. The event code ED2 is indicative of the time at which the magnitude exceeds the threshold value TH1.

On the other hand, if the flag FG1 is indicative of the synchronous playback, the central processing unit MP2 notifies the floppy disc player 8*a* of the detection of the peak through a control signal S1 as by step S35. Upon completion of the job at step S34 or S35, the central processing unit MP2 checks a flag to see whether or not the user has instructed to stop the synchronous recording/synchronous playback as by step S36. When the answer is given negative, the central processing unit MP2 returns to step S31. Thus, the central processing unit MP2 reiterates the loop consisting of steps S31 to S36 until the control is to return to the subroutine program for the synchronous recording. However, if the answer is given affirmative before the return, the central processing unit MP2 immediately returns to the subroutine program for the synchronous recording. Thus, the subroutine program is different from the subroutine program shown in FIG. 4 in that step S36 is added.

Turning back to FIG. 9, when the system controller 3 finds the first peak P1, the system controller 3 produces the event code ED2 (Sys-1), and transfers the event code ED2 (Sys-1) to the floppy disc recorder 8 as by step S23-1. The event code ED2 (Sys-1) makes the floppy disc recorder 8 automatically start the synchronous recording. The user starts to play a piece of music on the acoustic piano 11, and the MIDI event code generator 14*a* supplies the event codes ED1 representative of the note events through the system controller 3 to the floppy disc recorder 8. The sound system 1 produces the electric tones from the analog audio signal AL1. Thus, the user performs the piece of music in ensemble with the compact disc player/sound system AR/1.

The floppy disc recorder 8 stores the event code ED2 (Sys-1) in the track chunk TT. When the event code ED1 arrives at the floppy disc recorder 8, the floppy disc recorder 8 stores the event code ED1 in the track chunk TT, and starts to count the tempo clocks CLK2. The floppy disc recorder 8 counts up the tempo clocks CLK2 until the next event code ED1 reaches there, and stores the event code ED1 and duration data code representative of the time interval defined as the number of the tempo clocks in the track chunk TT.

While the floppy disc recorder 8 is recording the performance on the acoustic piano 11 in the floppy disc FD, the system controller 3 is assumed to find other peaks P2, P3, . . . and Pn. Whenever the system controller 3 finds the peak, the system controller 3 produces the event code ED2 for timing control, and supplies the event code ED2 to the floppy disc recorder 8. For this reason, the system controller 3 intermittently supplies the event codes ED2 (Sys-2), (Sys-3), . . . and (Sys-n) to the floppy disc recorder 3 as by step S23-2, S23-3, . . . and S23-n, and the floppy disc recorder 8 stores the event codes ED2 (Sys-2), ED2(Sys-2), . . . , and ED2(Sys-n) in the track chunk TT. Thus, the event codes ED2 for timing control are inserted into the MIDI music data codes in the track chunk TT together with the duration data codes representative of the time intervals between the event codes ED2 and the next event codes ED1 for making the piano tones synchronous with the electric tones.

When the user completes the performance, the user gives an end instruction through the manipulating panel 4 to the system controller 3. Then, the answer at step S36 (see FIG. 10) is given affirmative, and the central processing unit MP2 immediately returns to the subroutine program for the synchronous recording, and supplies the event code representative of the end of performance to the floppy disc recorder 8 as by step S24. The floppy disc recorder 8 writes the event code representative of the end in the track chunk TT, and completes the synchronous recording. Thus, the plural event codes ED2, i.e., Sys-1, Sys-2, Sys3, . . . Sys-n and duration data codes associated therewith are inserted into the set of MIDI music data codes in the track chunk TT.

The user is assumed to wish to reproduce his or her performance already recorded in the floppy disc FD in ensemble with the compact disc player AR' and sound system 1. The compact disc player AR' operates in response to the clock signal CLK1' different in frequency from the clock signal CLK1. The user connects the compact disc player AR' through the cable CB to the composite audio system MR as shown in FIG. 8B, and loads the floppy disc FD and compact disc CD into the floppy disc player 8*a* and compact disc player AR', respectively, in the preparatory works.

The user gives the wait instruction to the composite audio system MR as by step S25. The system controller 3 makes the main routine program branch to the subroutine program for the synchronous playback, and enters the subroutine program at every timer interruption.

Subsequently, the user gives the instruction for the synchronous playback to the compact disc player AR' as by step S26. The compact disc player AR' starts to read out the compact disc data codes in response to the clock signal CLK1', which is higher in frequency than the clock signal CLK1, and produces the analog audio signal AL1 from the audio data codes. The analog audio signal AL1 is supplied through the cable CB to the composite audio system MR. Since the compact disc player AR' reads out the compact disc data codes from the compact disc CD faster than those in the synchronous recording, the first peak P1' occurs earlier than the first peak P1, and the system controller 3 notifies the floppy disc player 8*a* of the detection of the first peak P1' through the control signal as by step S26-1. Then, the floppy disc player 8*a* is released from the waiting state, and starts to reads out the MIDI music data codes from the floppy disc FD. First, the event code ED1 (Sys-1) is read out from the floppy disc FD, and the event codes ED1/ED2 and duration data codes are intermittently read out from the floppy disc FD. When a duration data code is read out from the floppy disc FD, the floppy disc player 8*a* stores the duration data code in an internal register, and starts to decrement the number indicated by the duration data code in response to the tempo clocks CLK2. The floppy disc player 8*a* periodically checks the internal register to see whether or not the event code or codes ED1 are to be transferred to the system controller 3. When the number stored in the internal register reaches zero, the floppy disc player 8*a* transfers the event code or codes ED1 through the system controller 3 to the automatic player piano 20, and reads out the next duration data code and event code or codes ED1/ED2. Thus, the floppy disc player 8*a* intermittently supplies the event codes ED1 representative of the note events to the automatic player piano 20 for reproducing the performance. The analog audio signal AL1 is continuously transferred to the sound system 1 so that the electric tones are reproduced therefrom through the loud speakers 7. Thus, the automatic playing system 14 reproduces the performance in ensemble with the compact disc player AR' and sound system 1.

While the floppy disc player 8*a* is intermittently reading out the MIDI music data codes from the floppy disc FD, the system controller 3 checks the analog audio signal AL1 for the peaks P2, P3, . . . and Pn. The floppy disc driver 8*a* reads out the event codes ED2 (Sys-2'), (Sys-3'), . . . and (Sys-n') as by steps S26-2, S26-3, . . . and S26-n, and the times at which the event codes ED2 (Sys-2') to (Sys-n') are read out are later than the times at which the peaks P2', P2', . . . and Pn' occur due to the difference in frequency between the clock signals CLK1 and CLK1'. The time difference is increased with time.

In order to keep the piano tones synchronous with the electric tones, the floppy disc player 8*a* eliminates the time difference from therebetween as follows. First, when the floppy disc player 8*a* reads out the event code ED2(Sys-2), ED2(Sys-3), . . . or ED2(Sys-n) from the floppy disc FD together with the associated duration data code, the duration data code is stored in the internal register, and the floppy disc player 8*a* starts to decrement the number of tempo clocks CLK2 indicated by the duration data code in response to the tempo clocks CLK2. Since the clock signal CLK1' is higher in frequency than the clock signal CLK1, when the notice of the detection of peak P2, P3, . . . or Pn reaches the floppy disc player 8*a*, the number stored in the internal register has not reached zero, yet. The floppy disc player 8*a* compares the number stored in the internal register with a critical value to see whether or not the time difference is ignoreable.

If the number stored in the internal register is less than the critical value, the time difference is ignoreable, and the floppy disc player 8*a* continues to read out the next event code ED1/ED2 and duration data code and transfer the event code ED1 through the system controller 3 to the automatic player piano 20. However, if the number stored in the internal register is equal to or greater than the critical value, the time difference is serous, and the floppy disc player 8*a* accelerates the transmission of the event code ED1 so as to eliminate the time difference from between the time at which the notice arrived and the time at which the event code ED2 arrived.

One of the acceleration technologies is to forcibly reduce the number stored in the internal register to zero, and reads out the next duration data code and event code or codes ED1. If the time difference is too long to be eliminated from therebetween at the single equalization, the floppy disc player 8*a* repeats the forcible reduction until the time difference reaches zero. Although some event codes ED1 may be ignored, the composite audio system MR reproduces the piano tones well in ensemble with the compact disc player AR' and sound system 1.

If the time difference is stepwise decreased, the missing event codes ED1 are reduced. For example, the floppy disc player 8*a* divides the time difference by 2, and subtracts a certain number of tempo clocks equivalent to a half of the time difference from the number stored in the internal register. The floppy disc player 8*a* reads out the next event code or codes ED1 together with the duration data code. The floppy disc player 8*a* further eliminates the certain number equivalent to the other half from the number newly stored in the internal register. Thus, the floppy disc player 8*a* stepwise eliminates the time difference from therebetween through the plural data transmissions. If the divisor is increased, the missing event codes ED1 are minimized.

The time difference due to the clock signal CLK' or CLK" may be eliminated from between the arrival times through the following look-ahead technique. First, the floppy disc player 8*a* reads out a part of or all of the MIDI music data codes from the floppy disc FD, and stores an internal buffer. The floppy disc player 8*a* accumulates the time intervals between the event code ED2 (Sys-1') and event code ED2 (Sys-2'), and waits for the notice of the detection of peak P1'. When the notice of the detection of peak P1' reaches the floppy disc player 8*a*, the floppy disc player 8*a* starts an internal clock for measuring the lapse of time. When the notice of the detection of peak P2' reaches the floppy disc player 8*a*, the floppy disc player 8*a* stops the internal clock, and determines the time period between the notice of the detection of peak P1' and the notice of the detection of peak P2'. Then, the floppy disc player 8*a* compares the time period between the event codes ED2 (Sys-1) and ED2(Sys-2) with the time period between the peaks P1' and P2' to see whether or not the clock signal used in the compact disc player AR/AR'/AR" is identical with the clock signal used in the compact disc player AR. If the answer is given negative, the floppy disc player 8*a* calculates the different in clock period between the two clock signals, and forecasts the time differences between the reads-out event codes ED2 (Sys-3) to ED2 (Sys-n) and the notice of the detection of peaks P3' to Pn'. The floppy disc player 8*a* varies the time intervals indicated by the duration data codes so as to eliminate the time differences between the detection of the peaks P3' to Pn' and the read-out of the event codes ED2. Thus, the floppy disc player 8*a* preliminarily changes the duration data codes, and continues the read-out of the event codes ED1 and duration data codes for the ensemble.

As will be understood, the peaks P2–Pn are available for the synchronization between the reproduction of piano tones and reproduction of electric tones. As a result, the automatic player piano 20 reproduces the performance in ensemble with the compact disc player/sound system AR/1.

Even if the compact disc player AR'/AR" reads out the compact disc data codes in response to the clock signal CLK'/CLK" different in frequency from the clock signal CLK, the floppy disc player 8*a* adjusts the transmission of the event codes ED1 to the peaks P1', . . . and Pn' so that the automatic player piano 20 reproduces the performance synchronously with the reproduction of the piece of music through the compact disc player/sound system AR' or AR"/1.

Third Role of Peaks

FIGS. 10A and 10B show the compact disc player AR and composite audio systems MR/MR' connected through the cable CB for the synchronous recording and synchronous playback. In the synchronous recording, the compact disc player AR reads out the compact disc data codes from a compact disc CD in response to the clock signal CLK1, and the composite audio system MR records the MIDI music data codes in a floppy disc FD by using the tempo clock CLK2 for defining the time intervals. However, the composite audio system MR is replaced with the composite audio system MR' for the synchronous playback. The composite audio system MR' internally generates a tempo clock signal CLK2', which is higher in frequency than the clock signal CLK2, so that the absolute time interval measured in the synchronous playback is shorter than the absolute time interval measured in the synchronous recording.

Figure 11A:
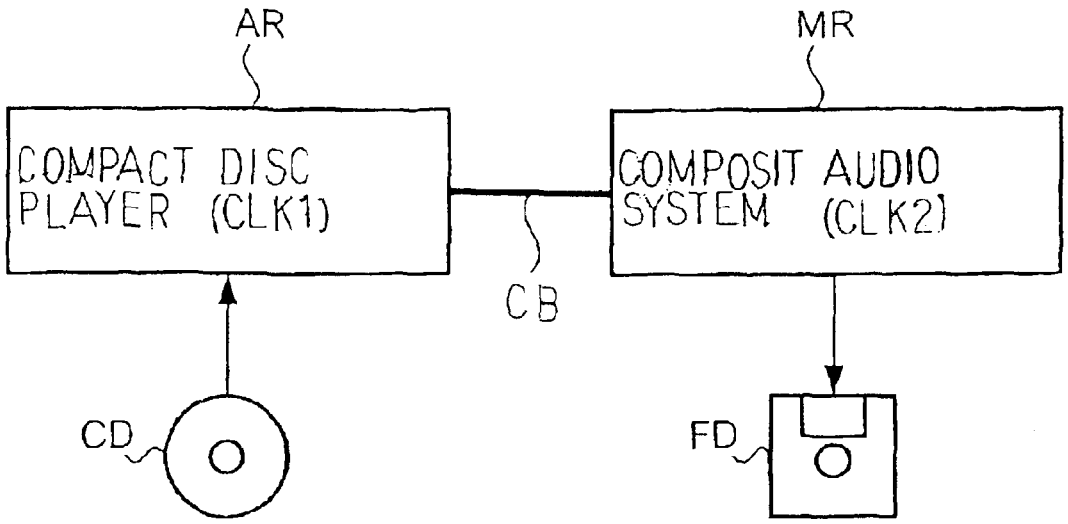
FIG. 11A is a block diagram showing the synchronous recording through the compact disc player and the composite audio system.
Figure 11B:
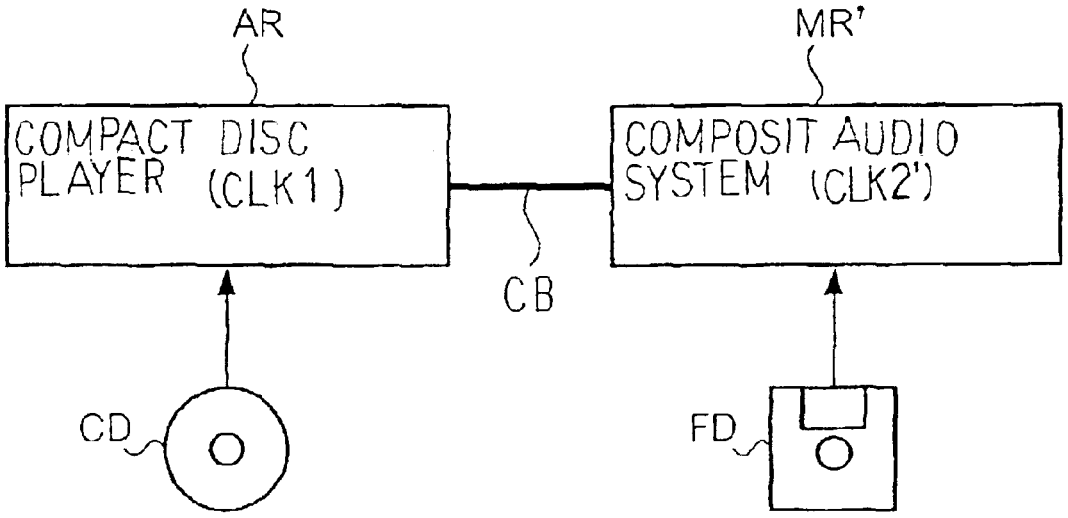
FIG. 11B is a block diagram showing yet another synchronous playback through the compact disc player and another composite audio system.
Figure 12:
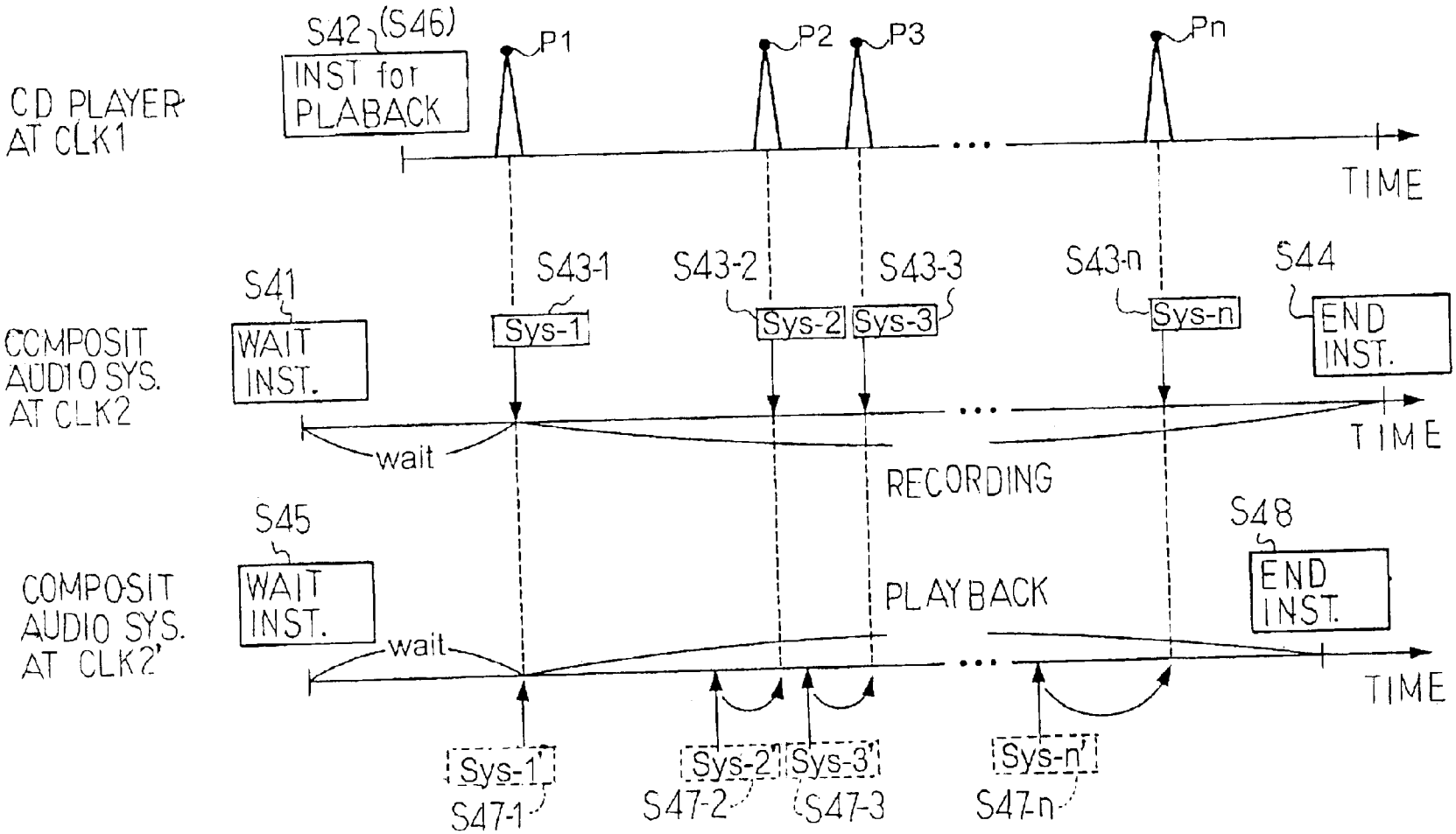
FIG. 12 is a timing chart showing the third role of peaks in the synchronous recording and synchronous playback.

FIG. 12 shows a sequence of the synchronous recording through the system shown in FIG. 11A and a sequence of the synchronous playback through the system shown in FIG. 11B. The preparatory works are similar to those described in conjunction with the first and second roles.

Upon completion of the preparatory works, the user gives a wait instruction to the composite audio system MR as by step S41. Then, the main routine program starts to branch to the subroutine program for the synchronous recording, and the central processing unit MP2 enters a subroutine program shown in FIG. 10 at every timer interruption.

Subsequently, the user gives an instruction for playback to the compact disc player AR as by step S42. The compact disc player AR starts to read out the compact disc data codes in response to the clock signal CLK1, and produces the analog audio signal AL1 from the audio data codes. The analog audio signal AL1 is transferred from the compact disc player AR through the cable CB to the composite audio system MR, and the system controller 3 periodically checks the momentary values of the analog audio signal AL1 for a peak through the subroutine program shown in FIG. 10.

When the system controller 3 finds the first peak P1, the system controller 3 produces the event code ED2 (Sys-1), and transfers the event code ED2 (Sys-1) to the floppy disc recorder 8 as by step S43-1. The event code ED2 (Sys-1) makes the floppy disc recorder 8 automatically start the synchronous recording. The user starts to play a piece of music on the acoustic piano 11, and the MIDI event code generator 14*a* supplies the event codes ED1 representative of the note events through the system controller 3 to the floppy disc recorder 8. The sound system 1 produces the electric tones from the analog audio signal AL1. Thus, the user performs the piece of music in ensemble with the compact disc player/sound system AR/1.

The floppy disc recorder 8 stores the event code ED2 (Sys-1) in the track chunk TT. When the event code ED1 arrives at the floppy disc recorder 8, the floppy disc recorder 8 stores the event code ED1 in the track chunk TT, and starts to count the tempo clocks CLK2. The floppy disc recorder 8 counts up the tempo clocks CLK2 until the next event code ED1 reaches there, and stores the event code ED1 and duration data code representative of the time interval defined as the number of the tempo clocks in the track chunk TT.

While the floppy disc recorder 8 is recording the performance on the acoustic piano 11 in the floppy disc FD, the system controller 3 is assumed to find other peaks P2, P3, . . . and Pn. Whenever the system controller 3 finds the peak, the system controller 3 produces the event code ED2 for timing control, and supplies the event code ED2 to the floppy disc recorder 8. For this reason, the system controller 3 intermittently supplies the event codes ED2 (Sys-2), (Sys-3), . . . and (Sys-n) to the floppy disc recorder 3 as by step S43-2, S43-3, . . . and S43-n, and the floppy disc recorder 8 stores the event codes ED2 (Sys-2), ED2 (Sys-2), . . . and ED2 (Sys-n) in the track chunk TT. Thus, the event codes ED2 for timing control are inserted into the MIDI music data codes in the track chunk TT for making the piano tones synchronous with the electric tones.

When the user completes the performance, the user gives an end instruction through the manipulating panel 4 to the system controller 3. Then, the answer at step S36 (see FIG. 10) is given affirmative, and the central processing unit MP2 immediately returns to the subroutine program for the synchronous recording, and supplies the event code representative of the end of performance to the floppy disc recorder 8 as by step S44. The floppy disc recorder 8 writes the event code representative of the end in the track chunk TT, and completes the synchronous recording. Thus, the plural event codes ED2, i.e., Sys-1, Sys-2, Sys3, . . . Sys-n are inserted into the set of MIDI music data codes in the track chunk TT.

The user is assumed to wish to reproduce his or her performance already recorded in the floppy disc FD through the composite audio system MR' in ensemble with the compact disc player AR and sound system 1. The composite audio system MR' defines each time interval between the note events as the number of tempo clock signal CLK2'. The user connects the compact disc player AR through the cable CB to the composite audio system MR' as shown in FIG. 11B, and loads the floppy disc FD and compact disc CD into the floppy disc player 8*a* and compact disc player AR, respectively, in the preparatory works.

Upon completion of the preparatory works, the user gives the wait instruction to the composite audio system MR' as by step S45. The system controller 3 makes the main routine program branch to the subroutine program for the synchronous playback, and the central processing unit MP2 periodically enters the subroutine program at the timer interruptions.

Subsequently, the user gives the instruction for the playback to the compact disc player AR as by step S46. The compact disc player AR starts to read out the compact disc data codes from the compact disc CD in response to the clock signal CLK1, and produces the analog audio signal AL1 from the audio data codes. The analog audio signal AL1 is supplied through the cable CB to the communication interface 2 of the composite audio system MR2. Since the clock signal CLK1 used in the synchronous playback is equal in frequency to the clock signal CLK1 used in the synchronous recording, the peaks P1, P2, P3, . . . and Pn occur at the timing same as that in the synchronous recording.

The system controller 3 transfers the analog audio signal AL1 to the sound system 1, and monitors the analog audio signal AL1 for the peaks. When the system controller 3 finds the first peak P1, the system controller 3 supplies a notice of the detection of peak to the floppy disc player 8*a*. Then, the floppy disc starts to read out the MIDI music data codes. The event code ED2(Sys-1) is firstly read out from the floppy disc FD as by step S47-1, and the event codes ED1/ED2 and associated duration data codes are intermittently read out from the floppy disc FD. When a duration data code is read out from the floppy disc FD, the floppy disc player 8*a* stores the duration data code in an internal register, and starts to decrement the number indicated by the duration data code in response to the tempo clocks CLK2'. The floppy disc player 8*a* periodically checks the number stored in the internal register to see whether or not the transmission timing comes for the event code or codes ED2. When the number stored in the internal register reaches zero, the floppy disc player 8*a* transfers the event code or codes ED1 through the system controller 3 to the automatic player piano 20, and reads out the next event code or codes ED1/ED2 together with the associated duration data code. The next duration data code is stored in the internal register. Thus, the floppy disc player 8*a* intermittently supplies the event codes ED1 representative of the note events to the automatic player piano 20 for reproducing the performance. The analog audio signal AL1 is continuously transferred to the sound system 1 so that the electric tones are reproduced therefrom through the loud speakers 7. Thus, the automatic playing system 14 reproduces the performance in ensemble with the compact disc player AR and sound system 1.

As described hereinbefore, the tempo clocks CLK2' in the synchronous playback are higher in frequency than the tempo clocks CLK2 in the synchronous recording. When the number indicated by the duration data code is decremented in response to the tempo clock CLK2', the absolute time period between events becomes shorter than the absolute time period between the events in the synchronous recording. This means that the event codes ED2(Sys-2'), ED2(Sys-3'), . . . and ED2(Sys-n') are read out from the floppy disc FD earlier than the notice of the detection of corresponding peaks P2, P3, . . . and Pn as by steps S47-2, S47-3, . . . and S47-n.

In order to eliminate the difference from between the read-out time of the event code ED2 and the arrival time of the notice, the floppy disc player 8*a* regulates the time interval between the events as follows. First, when the event code ED2 is read out from the floppy disc FD, the floppy disc player 8*a* starts an internal clock for measuring the time, and waits for the notice of the detection of corresponding peak. When the notice reaches the floppy disc player 8*a*, the floppy disc player 8*a* stops the internal clock, and determines the lapse of time from the read-out of the event code ED2 and the arrival of the notice. The floppy disc player 8*a* converts the lapse of time to a number of tempo clocks CLK2', and adds the regulative number to the number indicated by the next duration data code.

The aforementioned look ahead technique is employable in the composite audio system MR'.

As will be understood, even if the composite audio system MR is replaced with the composite audio system MR', the floppy disc player 8*a* periodically regulates the time period expressed by the duration time code to an appropriate value so that the composite audio system MR' reproduces the performance synchronously with the electric tones.

Fourth Role of Peaks

Figure 13:
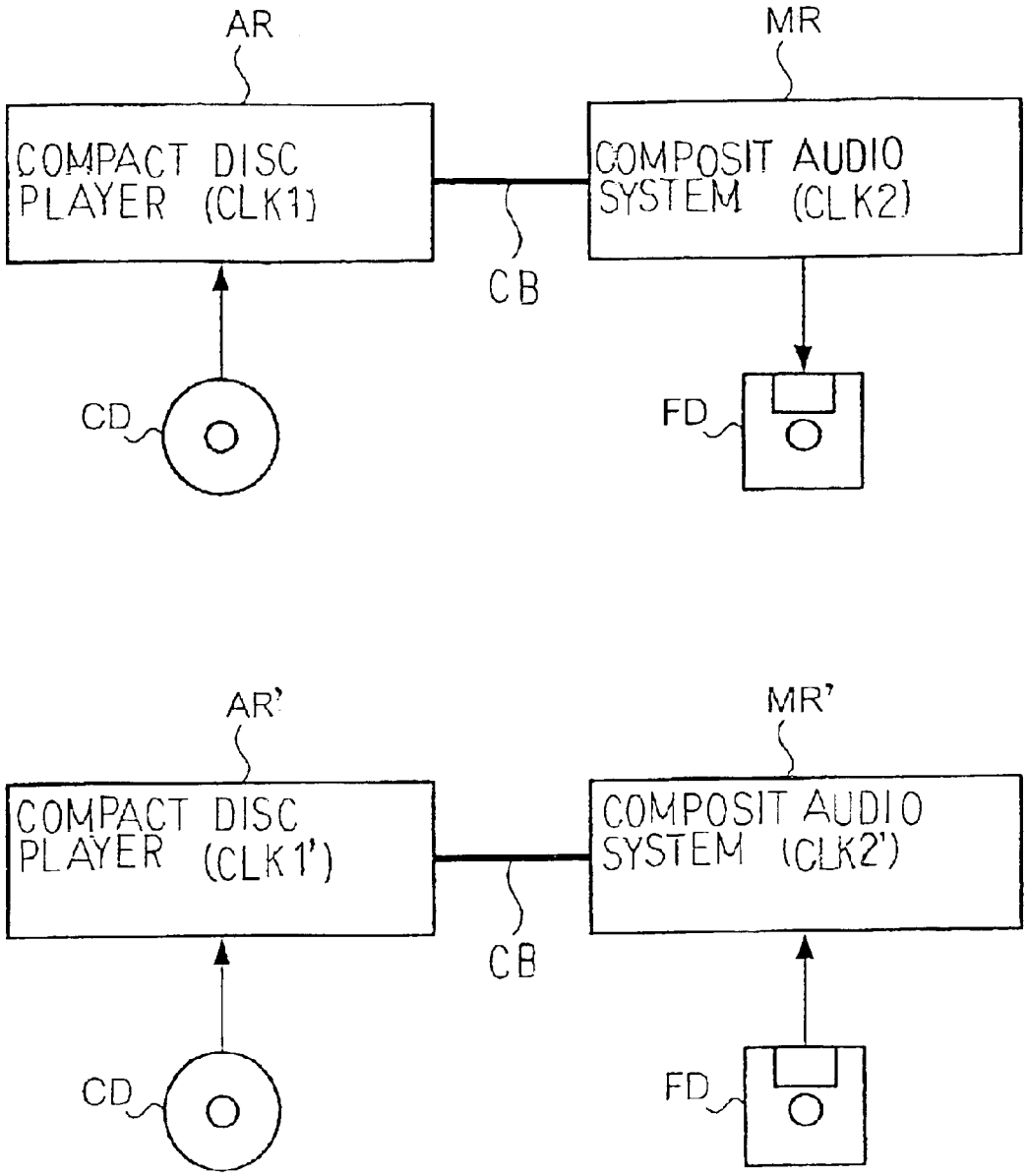
FIG. 13 is a block diagram showing the synchronous recording and synchronous playback through different combinations of compact disc players and composite audio systems.

FIG. 13 shows compact disc players AR/AR' and composite audio systems MR/MR' connected through the cable CB for the synchronous recording and synchronous playback. In the synchronous recording, the compact disc player AR reads out the compact disc data codes from a compact disc CD in response to the clock signal CLK1, and the composite audio system MR records the MIDI music data codes in a floppy disc FD by using the tempo clock CLK2 for defining the time intervals. However, the compact disc player AR and composite audio system MR are respectively replaced with the compact disc player AR' and composite audio system MR' for the synchronous playback. The compact disc player AR' is responsive to a clock signal CLK1' higher in frequency than the clock signal CLK1 for reading out the compact disc data codes from the compact disc CD. On the other hand, the composite audio system MR' internally generates a tempo clock signal CLK2', which is higher in frequency than the clock signal CLK2, so that the absolute time interval measured in the synchronous playback is shorter than the absolute time interval measured in the synchronous recording. The compact disc player AR and composite audio system MR may be used in a record company for manufacturing the sets of compact disc and floppy disc CD/FD. The other compact disc player AR' and composite audio system MR' may be owned by a user, and are used for an ensemble.

Figure 14:
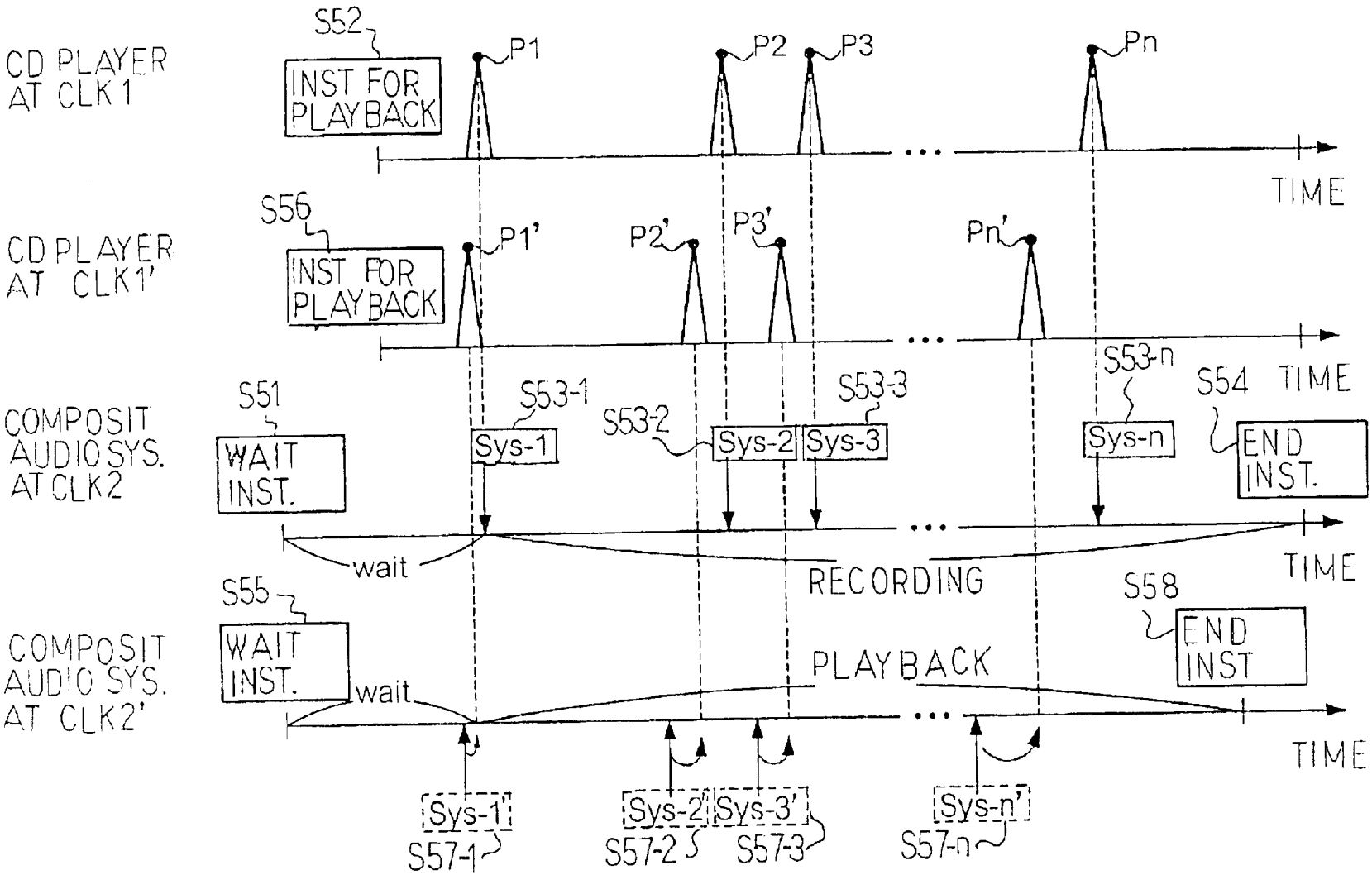
FIG. 14 is a timing chart showing the fourth role of peaks in the synchronous recording and synchronous playback.

FIG. 14 shows a sequence of the synchronous recording and a sequence of the synchronous playback. When the record company decides to record a performance on the acoustic piano 11 in ensemble with the compact disc player AR and sound system 1, an operator connects the compact disc player AR through the cable CB to the composite audio system MR, and loads a compact disc CD and a floppy disc FD into the compact disc player AR and composite audio system MR, respectively.

Upon completion of the preparatory works, the operator gives the wait instruction to the composite audio system MR as by step S51. The system controller 3 starts to make the main routine program branch to the subroutine program for the synchronous recording, and the central processing unit MP2 enters the subroutine program shown in FIG. 10 at every timer interruption.

Subsequently, the operator gives the instruction for the playback to the compact disc player AR as by step S52. Then, the compact disc player AR starts to read out the compact disc data codes from the compact disc CD in response to the clock signal CLK1, and produces the analog audio signal AL1 from the audio data codes. The analog audio signal AL1 is supplied through the cable CB to the composite audio system MR. The composite audio system MR transfers the analog audio signal AL1 to the sound system 1, and checks the analog audio signal AL1 for the local peak.

When the system controller 3 finds the first peak P1, the system controller 3 produces the event code ED2 (Sys-1), and supplies the event code ED2 (Sys-1) to the floppy disc recorder 8 as by step S53-1. The floppy disc recorder 8 starts the synchronous recording, and stores the event code ED2 (Sys-1) in the track chunk TT. A pianist starts to play a piece of music on the acoustic piano 11, and the MIDI event code generator 14*a* produces and supplies the event codes ED1 representative of the note events and pedal events through the system controller 3 to the floppy disc recorder 8. The system controller 3 continuously transfers the analog audio signal AL1 to the sound system, and the electric tones are radiated from the loud speakers 7. Thus, the pianist is performing the piece of music in ensemble with the electric tones.

While the pianist is playing the piece of music on the acoustic piano 11, the floppy disc recorder 8 determines the time intervals between the even codes ED1 as the number of tempo clocks CLK2, and stores the event codes ED1 and duration data codes representative of the time intervals in the track chunk TT. Whenever the system controller 3 finds another local peak P2, P3, . . . or Pn, the system controller 3 produces the event code ED2 (Sys-2), ED2(Sys-3), . . . or ED2(Sys-n), and supplies them to the floppy disc recorder 8. The floppy disc recorder determines the time interval between the previous event code ED1 and each event code ED2 for timing control, and stores the event code ED2 together with the duration code representative of the time interval in the track chunk TT as by step S53-2, S53-3, . . . and S53-n.

When pianist completes the performance on the acoustic piano 11, the operator gives the end instruction to the system controller 3 as by step S54. The system controller 3 acknowledges the end instruction, and supplies the event code representative of the end of performance to the floppy disc recorder 8. The floppy disc recorder 8 stores the event code representative of the end of performance in the track chunk TT, and fishes the synchronous recording.

A user is assumed to purchase the set of compact disc CD and floppy disc FD, and loads the compact disc CD and floppy disc FD in the compact disc player AR' and the floppy disc player 8*a* of the composite audio system MR'.

Upon completion of the preparatory work, the user gives the wait instruction to the system controller 3 as by step S55. The system controller 3 starts to make the main routine program branch to the subroutine program for the synchronous playback, and the central processing unit MP2 enters the subroutine program shown in FIG. 10 at every timer interruption.

Subsequently, the user gives the instruction for the playback to the compact disc player AR' as by step S56. The compact disc player AR' reads out the compact disc data codes from the compact disc CD in response to the clock signal CLK1', which is higher in frequency than the clock signal CLK1, and produces the analog audio signal AL1 from the audio data codes. The analog audio signal AL1 is supplied through the cable CB to the composite audio system MR'.

The system controller 3 transfers the analog audio signal AL1 to the sound system 1, and checks the analog audio signal AL1 for the peak P1'. Since the read-out clock signal CLK1' is higher in frequency than the read-out clock CLK1, the local peak P1' occurs earlier than the local peak P1. When the system controller 3 finds the local peak P1', the system controller 3 supplies the notice of the detection of peak P1' to the floppy disc player 8*a*. Then, the floppy disc player 8*a* starts to read out the MIDI music data codes from the floppy disc FD as by step S57-1. The event code ED2(Sys-1) is firstly read out from the track chunk TT in synchronism with the notice of the detection of peak P1', and the event codes ED1 and duration data codes follow.

When a duration data code is read out from the floppy disc FD, the floppy disc player 8*a* stores the duration data code in an internal register, and starts to decrement the number of tempo clocks CLK2 indicated by the duration data code in response to the tempo clocks CLK2'. However, the tempo clock CLK2' is higher in frequency than the tempo clock CLK2. The absolute time period indicated by the duration data code is shrunk, and the next event codes ED1/ED2 are read out from the floppy disc FD earlier than those recorded in the synchronous recording. Accordingly, the event codes ED1 are transferred through the system controller 3 to the automatic player piano 11, and the piano tones are generated at respective timings earlier than those in the synchronous recording. However, the electronic tones are also generated earlier than those in the synchronous recording, because the read-out clock signal CLK1' is higher in frequency than the read-out clock signal CLK.

In this situation, the composite audio system MR' makes the automatic player piano 20 reproduce the piano tones synchronously with the electric tones as follows. While the floppy disc player 8*a* is intermittently read out the MIDI music data codes, the event code ED2(Sys-2) is stored in the event buffer earlier than the notice of the detection of peak P2', or receives the notice of the detection of peak P2' earlier than the read-out of the event code ED2(Sys-2) as by step S57-2. When the floppy disc player 8*a* receives the event code ED2(Sys-2) or the notice of the detection of peak P2', the floppy disc player 8*a* starts an internal clock, and waits for the notice of the detection of peak P2' or the event code ED2 (Sys-2). When the notice or the event code ED2 reaches the floppy disc player 8*a*, the floppy disc player 8*a* stops the internal clock, and determines the lapse of time between the notice and the event code ED2. The floppy disc player 8*a* converts the lapse of time into a number of tempo clocks CLK2', and waits for the next duration data code. When the next duration data code is stored in the internal register, the floppy disc player 8*a* adds the regulative number to or subtracts it from the number of tempo clocks indicated by the duration data code. Thus, the floppy disc player 8*a* eliminates the difference between the event codes ED2(Sys-2) to ED2(Sys-n) and the peaks P2' to Pn' from the synchronous playback so that the automatic player piano 20 reproduces the performance in ensemble with the piece of music reproduced through the compact disc player AR1 and sound system 1. When the user gives the end instruction to the system controller 3, the floppy disc player 8*a* finishes the synchronous playback as by step S58.

As will be understood, even though both of the compact disc player and composite audio system are different between the synchronous recording and the synchronous playback, the composite audio system MR' makes the automatic player piano 20 reproduce the performance synchronously with the piece of music reproduced through the compact disc player AR' and sound system 1 by using the event codes ED2 and local peaks P2' to Pn'. The look-ahead technique is also desirable for the composite audio system MR' shown in FIG. 13.

Modifications

Although particular embodiments of the present invention have been shown and described, it will be apparent to those skilled in the art that various changes and modifications may be made without departing from the spirit and scope of the present invention.

For example, the compact disc player AR may communicate with the composite audio system MR through a radio channel. The bluetooth technologies, RiDA technologies (Infrared Data Association and Home RF (Radio Frequency) technologies are available for the wireless communication.

Figure 15:
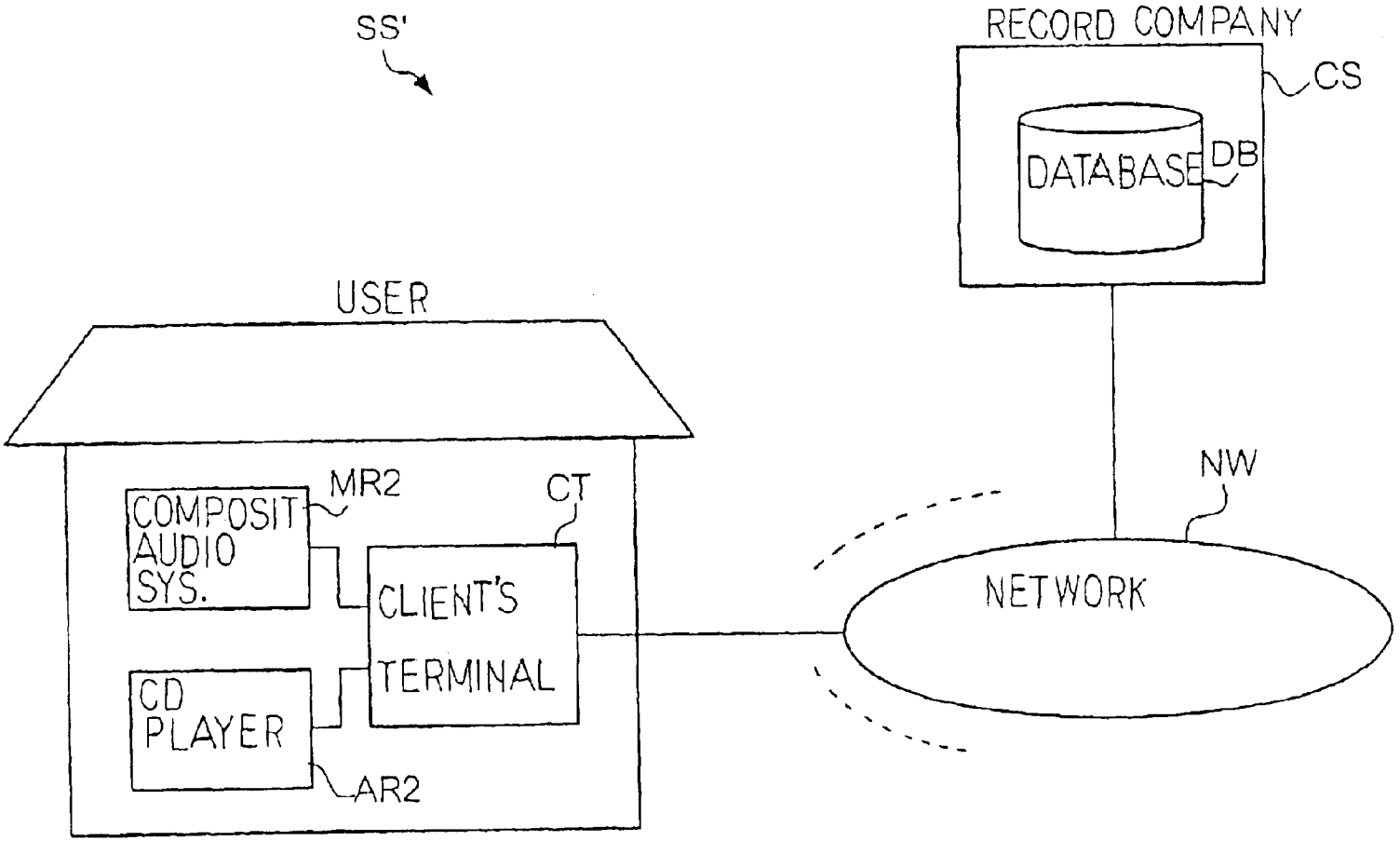
FIG. 15 is a schematic view showing a music distribution system according to the present invention.

The record company may distribute the pieces of music, which are stored in the compact disc and floppy disc in the system shown in FIG. 13, through a communication network such as, for example, the internet. FIG. 15 shows the music distribution system SS' according to the present invention. The music distribution system SS' comprises a contents server CS, a public or private communication network NW and user's terminals CT. The contents server CS includes a server computer (not shown) and a database DB where sets of ensemble data are stored. Each set of ensemble data contains a set of compact disc data codes to be reproduced through the compact disc players AR/AR'/AR"/AR2 and a set of MIDI music data codes to be reproduced through the composite audio systems MR/MR'/MR"/MR2. Sets of MIDI music data codes were recorded through one of the composite audio systems MR/MR'/MR" in synchronism with the compact disc players AR/AR'/AR". The server computer transfers a set of ensemble data from the database DB through the public/private communication network NW to the user on demand.

Although many users are under contract with the recording company, only one user is illustrated in FIG. 15. The user has a set of client's terminal CT, compact disc player AR2 and composite audio system MR2. The client's terminal CT is connected to the public/private network NW, and is communicable to the contents server CS. A personal computer system may serve as the client's terminal, and distributes the set of ensemble data to the composite audio system MR2 and compact disc player AR2. The composite audio system MR2 and compact disc player AR2 are similar in structure to the composite audio systems MR/MR'/MR" and compact disc players AR/AR'/AR", and the client's terminal CT is connected to the composite audio system MR2 and compact disc player AR2.

When the user wishes to reproduce an ensemble, the user requests the record company through the music distribution system SS'. The user inputs a URL (Uniform Resource Locator) representative of the contents server CS and an IP address to the client's terminal CT, and requests the contents server CS to transfer pieces of contents information representative of the ensemble music stored in the database DB. The contents server CS is responsive to the request so that the client's terminal CT receives the pieces of contents information. The client's terminal CT produces visual images representative of the pieces of ensemble music on a display screen. The user looks for the piece of ensemble music to be required. When the user finds the piece of ensemble music, the user requests the contents server CS to transfer the set of ensemble data through the public/private network NW. Then, the contents server CS starts to supply the set of ensemble data through the public/private network NW to the client's terminal CT.

Figure 16A:
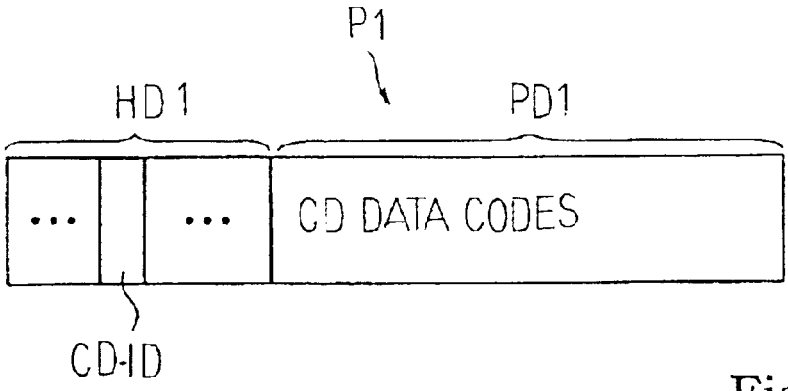
FIGS. 16A and 16B are views showing formats for a packet distributed through the music distribution system.
Figure 16B:
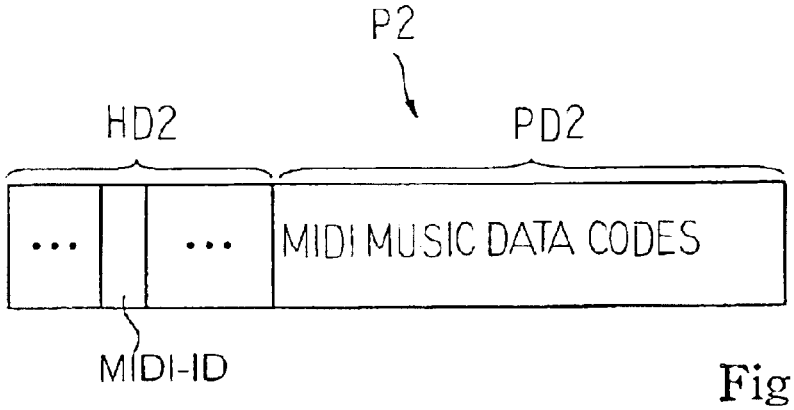

Two sorts of packets P1/P2 are used for the distribution of the ensemble data (see FIGS. 16A and 16B). The packets P1 are used in the transmission of the compact disc data codes, and the other packets P2 carry the MIDI music data codes to the client's terminal CT. A header HD1 and a payload PD1 form each packet P1. An address code representative of the destination and an identification code CD-ID representative of the compact disc data codes are stored in the header HD1, and the compact disc data codes are carried as the payload PD1. The packet P2 also has a data field assigned to a header HD2 and a data field assigned to a payload PD2. An address code representative of the destination and an identification code MIDI-ID representative of the MIDI music data codes are stored in the header HD2, and the payload PD2 is the MIDI music data codes.

The client's terminal CT receives the packets P1/P2. The client's terminal CT checks the identification code CD-ID/MIDI-ID to see whether the payloads PD1/PD2 are to be transferred to the composite audio system MR2 or the compact disc player AR2. If the received payload is directed to the composite audio system MR2, the client's terminal CT supplies the MIDI music data codes to the composite audio system MR2, and the MIDI music data codes are stored in a suitable memory. On the other hand, when the received payload is directed to the compact disc player AR2, the client's terminal CT supplies the compact disc data codes to the compact disc player AR2, and the compact disc data codes are stored in a suitable memory. Thus, the client's terminal CT repeats the above-described jobs, and selectively transfers the payloads PD1/PD2 to the composite audio system MR2 and the compact disc player AR2. The compact disc data codes/MIDI music data codes may be stored in volatile memories such as random access memories or non-volatile memories such as hard disc units.

The user connects the composite audio system MR2 to the compact disc player AR2 through the cable CB in the preparatory work. The user gives the wait instruction to the composite audio system MR2 and the instruction for the playback to the compact disc player AR2. The sequence for reproducing the ensemble is similar to that shown in FIG. 14, and no further description is hereinafter incorporated for the sake of simplicity.

In the music distribution system SS', the packets P1/P2 are received by the client's terminal CT, and the client's terminal CT distributes the compact disc data codes and MIDI music data codes to the compact disc player AR2 and composite audio system MR2. In case where a composite audio system with a built-in communication device and a compact disc player with a built-in communication device are directly connected to the network NW, the composite audio system and compact disc player checks the identification codes CD-ID/MIDI-ID to see whether the received packet is addressed thereto, and selectively receives the packets P1/P2.

If the composite audio system MR2 and compact disc player AR2 are disconnected from the client's terminal CT, the client's terminal CT may store the packets P1/P2 in a suitable memory such as, for example, a hard disc unit. After the reception of the packets P1/P2, the user would connect the composite audio system MR2 and compact disc player AR2 to the client's terminal CT through the cable CB. When the user requests the client's terminal CT to distribute the payloads PD1/PD2, the client's terminal CT checks the identification code CD-ID/MIDI-ID for determining the destination, and distributes the payloads PD1/PD2 to the composite audio system MR2 and compact disc player AR2 depending upon the identification codes CD-ID/MIDI-ID.

Other sorts of communication terminals may serve as the client's terminal CT. Examples of the communication terminals available for the music distribution system are cell phones, handy phones for the PHS (Personal Handy-phone System) and PDAs (Personal Digital Assistance).

Sets of MIDI music data codes may be further stored in the database DB without the associated sets of compact disc data codes. The sets of MIDI music data codes are representative of performances by famous players in ensemble with the pieces of music represented by the associated sets of compact disc data codes. The user buys the compact disc where the piece of music is stored, and asks the contents server CB whose performances are stored in the database. When the user finds a favorite player, he or she downloads the set of MIDI music data codes representative of his or her performance. The user enjoys the ensemble through the compact disc player and composite audio system.

Figure 17:
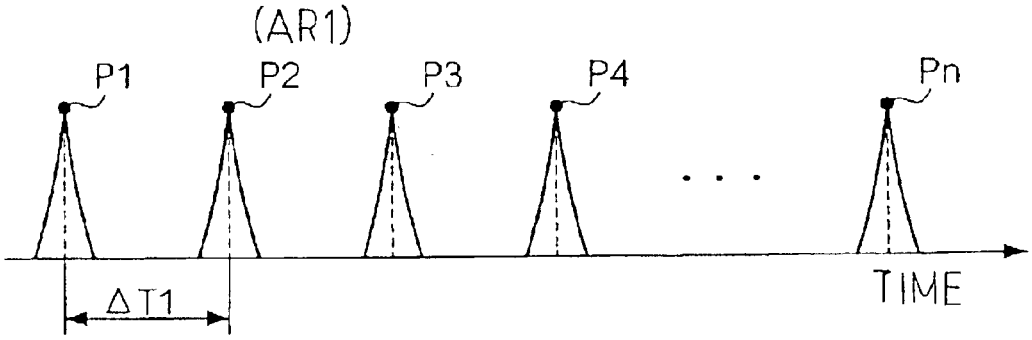
FIG. 17 is a view showing peaks reproduced from an analog audio signal.

FIG. 17 shows peaks P1, P2, P3, P4, . . . and Pn in an analog audio signal reproduced from a master compact disc through a compact disc player. While the piece of music is being reproduced through a compact disc player AR1, the peaks P1 to Pn occur at regular time intervals of ΔT1. The compact disc player AR reads out the compact disc data codes in response to a standard clock signal CLK1. The frequency of the standard clock signal CLK1 is known to the manufacturers, and is stored in other sorts of compact disc players as a part of the basic data information.

A user bought the master compact disc. The user is assumed to reproduce the piece of music through a compact disc player AR2 and the composite audio system MR. The compact disc player AR2 reads out the compact disc data codes in response to a clock signal CLK1' different in frequency from the standard clock signal CLK1. The user connects the compact disc player AR2 to the composite audio system MR through the cable CB, and loads the master compact disc and a floppy disc storing another part of the piece of music.

Then, the compact disc player AR2 reads out the compact disc data codes in response to the clock signal CLK1', and supplies the analog audio signal to the composite audio system MR. The composite audio system MR analyzes the analog audio signal without producing the electric tones, and determines time intervals among the peaks. Since the clock signal CLK1' is different in frequency from the standard clock signal CLK1, the time intervals are also different from the time intervals ΔT1. The composite audio system MR determines the ratio between the frequency of the clock signal CLK1' and the frequency of the standard clock signal CLK1. The composite audio system MR reads out the MIDI music data codes from the floppy disc, and changes the duration data codes from the original values to appropriate values.

When the user instructs the composite audio system MR and compact disc player AR2 to reproduce the piece of music in ensemble, the compact disc player reads out the compact disc data codes in response to the clock signal CLK1', and the composite audio system MR intermittently reads out the MIDI music data codes at the time intervals indicated by the modified duration data codes.

The master compact disc may be downloaded from a server computer through a communication network.

The audio data codes/time data codes and MIDI music data codes may be stored in other sorts of information storage media such as, for example, minidiscs, magnetic tape cassettes and record discs. For this reason, the audio data codes/time data codes may be read out through an audio player system, a magnetic tape recorder/player, a record player or a personal computer. Similarly, the floppy disc recorder/player 8/8*a* are replaced with the audio player system, a compact disc player, an audio player system, a magnetic tape recorder/player, a record player or a personal computer system.

The composite audio system and compact disc player may be built in a monolithic structure. The monolithic structure may be in the form of an advanced automatic player piano. Using the advanced automatic player piano, user records a part of an ensemble in a suitable information storage medium such as a floppy disc or compact disc, and reproduces the ensemble through the advanced automatic player piano without the preparatory work.

The composite audio system may record a speech or natural sound in an information storage medium in the form of MIDI music data codes, i.e., the event codes for note events, duration data codes and event codes for timing control in ensemble with a piece of music produced from the audio data codes/time data codes, and reproduce the speech or natural sound from the MIDI music data codes in ensemble with the piece of music.

The pieces of music may be represented by data codes formatted differently from the audio data/time data codes and MIDI music data codes. In other words, the compact disc data codes and MIDI music data codes do not set any limit on the technical scope of the present invention.

In case where a composite audio system is used as a recorder or a player, the automatic playing system 14 or data generating system is removed from the automatic player piano 20.

Relation Between Claims and Embodiments

Recorder and Recording Method

Figure 10:
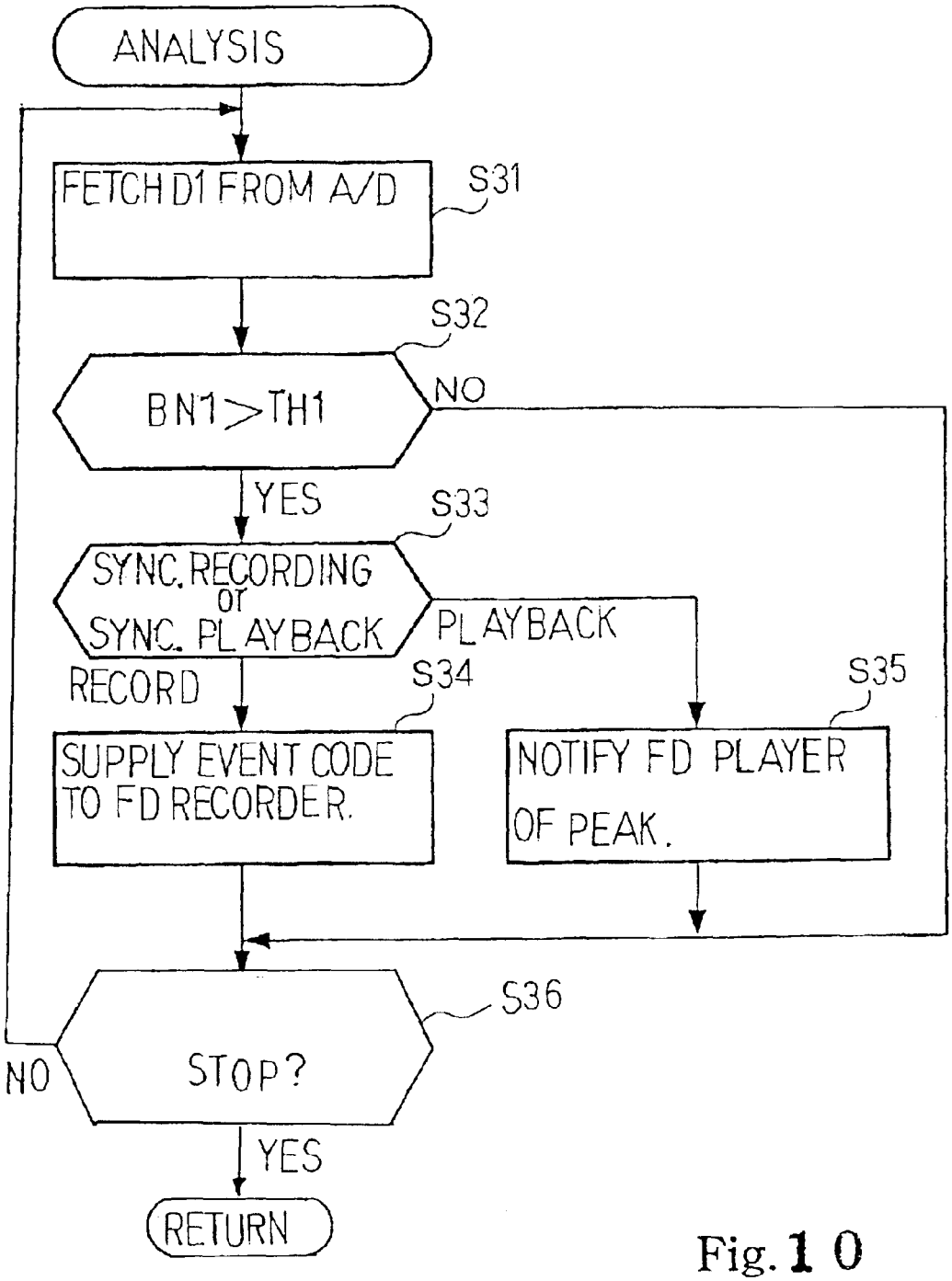
FIG. 10 is a flowchart showing a subroutine program executed at every timer interruption.

The system controller 3 and subroutine program shown in FIG. 4 or 10 as a whole constitute a first analyzer, and the microprocessor 8*c* and the instructions of the subroutine program for measuring the time intervals between the event codes as a whole constitute a second analyzer. The read/write head 8*b*, the microprocessor 8*c* and the instructions of the subroutine program for writing the event code/codes and associated duration data code as a whole constitute a writer. The local peak P1 is corresponding to at least one local peak, and the peaks P2, P3, . . . and Pn serve as other local peaks. The event code ED2(Sys-1), duration data codes, event codes ED1 and audio data codes are respectively corresponding to at least one piece of timing data, pieces of second timing data, pieces of first data and pieces of second data.

The musical instrument is corresponding to the acoustic piano 11, and black/white keys on the keyboard 11*a* and pedals 11*e* serve as plural manipulators. The MIDI event code generator 14*a* is corresponding to an information processing unit.

Player and Playing Method

The first analyzer is same as that of the recorder. The automatic playing system 14 and acoustic piano 11 as a whole constitute a data-to-sound converter. The floppy disc player 8*a*, i.e., the read/write head 8*b*, microprocessor 8*c* and subroutine program for the synchronous playback form in combination a read-out device. The pieces of first data, pieces of second data, pieces of first timing data and pieces of second timing data are identical with those of the recorder and recording method.

Composite Audio System

The composite audio system comprises the recorder and player, and the relation between the claim languages and the component parts of the embodiment are presumable from the above-described relation.

What is claimed is:

1. A recorder for recording a first passage in an information storage medium as pieces of first data in ensemble with a second passage produced on the basis of pieces of second data different in data format from said pieces of first data, comprising:

a first analyzer analyzing an analog signal produced in response to a first clock signal for detecting at least one local peak of said analog signal, and producing at least one piece of first timing data;

a second analyzer analyzing said pieces of first data and said at least one piece of first timing data for determining time intervals among said pieces of first data and said at least one piece of first timing data, and producing pieces of second timing data each representative of one of said time intervals as a number of clocks of a second clock signal without a guarantee that a frequency thereof is equal to a frequency of said first clock signal; and a writer connected to said first analyzer, said second analyzer and a source of said pieces of first data, and writing said at least one piece of first timing data, said pieces of first data and said pieces of second timing data in said information storage medium.

2. The recorder as set forth in claim 1, in which said pieces of first data and said pieces of second data are respectively expressed by a set of event codes and duration codes and a series of audio data codes representative of momentary values of magnitude on said analog signal, and each of said event codes and associated one of said duration data codes represent an event in said first passage and a time interval between said event and the next event.

3. The recorder as set forth in claim 2, in which said event codes and said duration codes are defined in MIDI (Musical Instrument Digital Interface) standards.

4. The recorder as set forth in claim 1, in which said source of said pieces of first data includes a musical instrument equipped with plural manipulators for performing said first passage and a data generating system, and said data generating system has sensors monitoring said plural manipulators to see whether or not any one of said plural manipulators is moved for producing detecting signals and an information processing unit processing said detecting signals for producing said pieces of first data.

5. The recorder as set forth in claim 4, in which said musical instrument is an acoustic piano.

6. The recorder as set forth in claim 5, in which said musical instrument is equipped with an automatic playing system.

7. The recorder as set forth in claim 1, in which said first analyzer further analyzes said analog signal for producing other piece of first timing data representative of other local peaks of said analog signal, and said second analyzer further analyzes said other pieces of first timing data and said pieces of first data for said time intervals so that said pieces of second timing data represent said time intervals among said at least one piece of first timing data, said pieces of first data and said other pieces of first data.

8. The recorder as set forth in claim 7, in which said at least one piece of first timing data gives a timing to start a synchronous playback, and said other pieces of first timing data give synchronous timings for making a data read-out from said information storage medium synchronized with said analog signal in said synchronous playback.

9. A method for recording a performance along a first passage in an information storage medium as pieces of first data in ensemble with a second passage produced on the basis of pieces of second data different in data format from said pieces of first data, comprising the steps of:

a) producing an analog signal representative of said second passage from said pieces of second data in response to a first clock signal;

b) monitoring said analog signal to see whether or not a local peak occurs in said analog signal;

c) producing a piece of first timing data when said local peak occurs;

d) analyzing said piece of first timing data and said pieces of first data for producing a piece of second timing data representative of a time interval between said piece of first timing data and one of said pieces of first data; and e) storing said piece of first timing data, said piece of second timing data and said pieces of first data in said information storage medium.

10. The method as set forth in claim 9, further comprising the steps of f) monitoring said analog signal to see whether or not another local peak occurs in said analog signal;

g) producing another piece of first timing data representative of said another local peak;

h) analyzing said another piece of first timing data and said pieces of first data for producing another piece of second timing data representative of another time interval between said another piece of first timing data and associated one of said pieces of first data;

i) storing said another piece of second timing data in said information storage medium, and j) repeating said steps f) to i) until reception of an instruction for stopping the recording.

11. The method as set forth in claim 10, in which said piece of first timing data gives a timing to start a synchronous playback, and said another piece of first timing data gives a synchronous timing for making a data read-out from information storage medium synchronized with said analog signal in said synchronous playback.

12. A player for reproducing a first passage from pieces of first data in ensemble with a second passage produced on the basis of pieces of second data different in data format from said pieces of first data, comprising:

a first analyzer analyzing an analog signal produced from said pieces of second data in response to a first clock signal for detecting at least one local peak in said analog signal, and producing a piece of first timing data representative of an occurrence of said at least one local peak;

a data-to-sound converter for producing said first passage from said pieces of first data; and a read-out device connected to said first analyzer and said data-to-sound converter, and responsive to said piece of first timing data so as to start to read out said pieces of second timing data and said pieces of first data from said information storage medium, said read-out device measuring a time period defined by each piece of second timing data read out from said information storage medium as a number of clocks of a second clock signal without a guarantee that a frequency thereof is equal to a frequency of said first clock signal for transferring associated one or ones of said pieces of first data to said data-to-sound converter when said time period is expired.

13. The player as set forth in claim 12, in which said first analyzer further analyzes said analog signal for producing other pieces of first timing data representative of occurrences of other local peaks in said analog signal, and said read-out device compares pieces of first read-out timing data representative of said other local peaks stored in said information storage medium in a recording with said other pieces of first timing data to see whether or not each of said other pieces of first read-out timing data is read out from said information storage medium substantially concurrently with associated one of said pieces of first timing data, said read-out device changing the timing to transfer selected one or ones of said pieces of first data to said data-to-sound converter to another timing when the answer is given negative.

14. The player as set forth in claim 13, in which said read-out device determines a number of the clocks of said second clock signal equivalent to a time difference between said the read-out of said each of said other pieces of first read-out timing data and arrival of said associated one of said pieces of first timing data when said answer is given negative, and adds said number of said clocks equivalent to said time difference to or subtracts said number from the number of said clocks of said second clock signal indicated by associated one of said pieces of second timing data.

15. The player as set forth in claim 14, in which said read-out device divides said number of said clocks equivalent to said time difference by a natural number, and sequentially adds the product of the division to or subtract said product from the numbers of said clocks indicated by the plural pieces of second timing data.

16. The player as set forth in claim 13, in which said read-out device forecasts the time difference between said read-out of said each of said other pieces of first read-out timing data and arrival of said associated one of said pieces of first timing data, and preliminarily changes the numbers of said clocks of said second clock signal indicated by selected ones of said pieces of second timing data.

17. The player as set forth in claim 13, in which said data-to-sound converter is an automatic player piano.

18. The player as set forth in claim 17, in which said automatic player piano includes a tone generator for producing electronic tones on the basis of said pieces of first data.

19. The player as set forth in claim 13, in which said pieces of first data, said pieces of second timing data and said pieces of second data represents events in said first passage, time intervals each between one of said events and the previous event and momentary values of a magnitude of said analog signal, respectively.

20. The player as set forth in claim 19, in which said events and said time intervals are defined in MIDI (Musical Instrument Digital Interface) standards.

21. The player as set forth in claim 12, in which said pieces of first data and said pieces of second timing data are supplied to said information storage medium from a database through a network.

22. A method of reproducing a first passage from pieces of first data in ensemble with a second passage produced on the basis of pieces of second data different in data format from said pieces of first data, comprising the steps of:

a) producing an analog signal representative of said second passage from said pieces of second data in response to a first clock signal;

b) monitoring said analog signal to see whether or not a local peak occurs in said analog signal;

c) producing a piece of first timing data when said local peak occurs;

d) reading out a piece of second timing data representative of a time interval between a piece of first read-out timing data representative of said local peak in a recording and one of said pieces of first data and said one of said pieces of first data from an information storage medium; and e) producing a tone or tones of said first passage on the basis of said one of said pieces of first data when said time interval is expired.

23. The method as set forth in claim 22, further comprising the steps of f) monitoring said analog signal for detecting another local peak in said analog signal, g) producing another piece of first timing data when said another local peak is detected, h) reading out another piece of first read-out data representative of said another local peak in said recording while other pieces of first data and other pieces of second timing data are being intermittently read out from said information storage medium, i) comparing said another piece of first read-out data with said another piece of first timing to see whether or not said another piece of first read-out data is read out substantially concurrently with the production of said another piece of first timing data, j) modifying associated one of said pieces of second timing data for eliminating the time difference from therebetween when the answer at step i) is given negative;

k) producing another tone or tones on the basis of associated one or ones of said first data when said answer at step i) is given affirmative, and l) repeating said steps f) to k) until the read-out from said information storage medium is to be completed.

24. The method as set forth in claim 23, in which said step j) includes the sub-steps of j-1) determining a number of said clocks of said second clock signal equivalent to a time difference between the read-out of said another piece of first read-out timing data and the arrival of said another piece of first timing data, j-2) dividing said number of said clocks by a natural number, j-3) adding the product of the division to or subtract said product from a number of the clocks of said second clock signal indicated by associated one of said pieces of second timing data, and j-4) repeating said step j-3) until the total of said products becomes equal to said number of said clocks equivalent to said time difference.

25. A composite audio system for recording a first passage in an information storage medium as pieces of first data in ensemble with a second passage represented by pieces of second data different in data format from said pieces of first data and reproducing said first passage in ensemble with said second passage, comprising:

a recorder including a first analyzer analyzing an analog signal produced in response to a first clock signal for detecting at least one local peak of said analog signal and producing at least one piece of first timing data in a recording, a second analyzer analyzing said pieces of first data and said at least one piece of first timing data for determining time intervals among said pieces of first data and said at least one piece of first timing data and producing pieces of second timing data each representative of one of said time intervals as a number of clocks of a second clock signal without a guarantee that a frequency thereof is equal to a frequency of said first clock signal, and a writer connected to said first analyzer, said second analyzer and a source of said pieces of first data and writing said at least one piece of first timing data, said pieces of first data and said pieces of second timing data in said information storage medium; and a player including said first analyzer further analyzing said analog signal for detecting said at least one local peak and producing said piece of first timing data representative of an occurrence of said at least one local peak in a playback, a data-to-sound converter for producing said first passage from said pieces of first data transferred from said information storage medium, and a read-out device connected to said first analyzer and said data-to-sound converter and responsive to said piece of first timing data so as start to read out said pieces of second timing data and said pieces of first data from said information storage medium, said read-out device measuring a time period defined by each piece of second timing data read out from said information storage medium as a number of clocks of a second clock signal without a guarantee that a frequency thereof is equal to a frequency of said first clock signal for transferring associated one or ones of said pieces of first data to said data-to-sound converter when said time period is expired.

26. The composite audio system as set forth in claim 25, in which said pieces of first data and said pieces of second data are respectively expressed by a set of event codes and duration codes and a series of audio data codes representative of momentary values of magnitude on said analog signal, and each of said event codes and associated one of said duration data codes represent an event in said first passage and a time interval between said event and the next event.

27. The composite audio system as set forth in claim 25, in which said event codes and said duration codes are defined in MIDI (Musical Instrument Digital Interface) standards.

28. The composite audio system as set forth in claim 25, in which said first analyzer further analyzes said analog signal for producing other piece of first timing data representative of other local peaks of said analog signal, said second analyzer further analyzes said other pieces of first timing data and said pieces of first data for said time intervals so that said pieces of second timing data represent said time intervals among said at least one piece of first timing data, said pieces of first data and said other pieces of first data, said read-out device compares pieces of first read-out timing data representative of said other local peaks stored in said information storage medium in a recording with said other pieces of first timing data to see whether or not each of said other pieces of first read-out timing data is read out from said information storage medium substantially concurrently with associated one of said pieces of first timing data, and said read-out device changes the timing to transfer selected one or ones of said pieces of first data to said data-to-sound converter to another timing when the answer is given negative.

29. The composite audio system as set forth in claim 25, further comprising a source of said pieces of second data connected to said recorder and said player.

* * * * *